US006079818A

United States Patent [19]

Wakahara et al.

[11] Patent Number: 6,079,818

[45] Date of Patent: Jun. 27, 2000

[54] IMAGE FORMING APPARATUS FORMING IMAGES USING JUMPING TONER/ DEVELOPER

[75] Inventors: Shirou Wakahara, Chiba; Iwakazu Honda, Kitakatsuragi-gun; Katsumi Adachi; Yukihito Nishio, both of Ikoma-gun, all of Japan

[73] Assignee: Sharp Kabushiki Kaisha, Osaka, Japan

[21] Appl. No.: 09/070,978

[22] Filed: May 1, 1998

[30] Foreign Application Priority Data

May 13, 1997 [JP] Japan ..... 9-122674

[51] Int. Cl.[7] ..... B41J 2/06

[52] U.S. Cl. ..... 347/55

[58] Field of Search ..... 347/55, 112, 120, 347/123, 128, 141; 399/135

[56] References Cited

U.S. PATENT DOCUMENTS 3,898,674 8/1975 Koch ..... 347/55
5,596,356 1/1997 Lee ..... 347/55
5,781,218 7/1998 Wakahara et al. ..... 347/141
5,874,973 2/1999 Wakahara ..... 347/55

FOREIGN PATENT DOCUMENTS 6-227020 8/1994 Japan .
8-99433 4/1996 Japan .

*Primary Examiner*—Sandra Brase
*Attorney, Agent, or Firm*—Dike, Bronstein, Roberts & Cushman, LLP; David G. Conlin; William J. Daley, Jr.

[57] ABSTRACT

An image forming unit has a toner supplying section and a printing section, and directly forms an image with the developer, in accordance with the image signal, onto a sheet of paper as the recording medium. The control electrode has a shield electrode in which the positions of the openings, the applied voltage and the diameters of the openings are controlled so that the jumping of the toner passing through the gates can be controlled finely and uniformly without being affected by the distances from the toner support to the opposing electrode and control electrode. A further shield electrode can be provided to perform further precise toner control and hence produce highly qualified images.

11 Claims, 27 Drawing Sheets

1
2
3
4
5
6
7
8
10
11
12
13
14
15
16a
16b
17
18
19
20
21
22
23
24
25
26
27
28
29
30
31
39
40
80
A
B

Relationship between the diameter of the opening of the shield electrode and the jumping amount of toner

IMAGE FORMING APPARATUS FORMING IMAGES USING JUMPING TONER/ DEVELOPER

BACKGROUND OF THE INVENTION (1) Field of the Invention

The present invention relates to an image forming apparatus which forms images on the recording medium by causing the developer to jump thereto and can be applied to a digital copier, the printer in facsimile machines as well as to digital printers, plotters, etc.

(2) Description of the Prior Art

In recent years, as the image forming means for producing a visual image on recording medium such as recording paper etc., in response to an image signal, there have been various disclosures proposed such as Japanese Patent Application Laid-Open Hei 6 No. 227,020 as well as Japanese Patent Application Laid-Open Hei 8 No. 99,433. The image forming apparatuses in these disclosures are ones in which charged particles are placed in an electric field so that they will jump by electric force whilst the potential being applied to the control electrode, having a number of passage holes and located in the jump path, is being varied, to thereby make the developer particles adhere to the recording medium located on the surface of the opposing electrode, thus forming a visual image on the recording medium, directly.

In these apparatuses disclosed in Japanese Patent Application Laid-Open Hei 6 No. 227,020 and Japanese Patent Application Laid-Open Hei 8 No. 99,433, the control electrode is provided with a shield electrode on the side facing the opposing electrode so that it will shield electric effects on the toner support from a plurality of electrode elements and their feeder lines, or has a matrix control configuration for implementing control of jumping of the toner.

An image forming apparatus having the type represented by the above prior art uses a control means for controlling the passage of the charged particles through gates. A single electrode plate having openings at positions corresponding to the gates of the control electrode arranged as the control means on the side facing toner support is provided. However, since the jumping amount of the toner is controlled by the electric field formed between the gate and toner support, the jumping amount of the toner changes as the electric field varies.

In a configuration using a cylindrical sleeve as the toner support and a two-dimensional gate array as the control electrode, the distance between the sleeve and the control electrode varies due to the curvature of the sleeve. At the side areas of the support, the distance from the control electrode is greater than that from the central portion. Accordingly, the electric field at areas to the side is weak so that dots formed in these areas will be low in density causing difficulty in yielding the correct contrast.

As countermeasures against this, some manipulations have been used such as increasing the voltage being applied to the electrode at areas to the side when toner passes through. However, the configuration in which the voltage for controlling the jumping toner is adjusted not only needed an increased number of power sources but, also needed extra high withstanding voltage FETs as the means for switching the voltage. This further necessitated insulation against the high voltage, needing more parts and unavoidably resulting in increase in size and cost of the apparatus.

If the control voltage for controlling the jumping of toner is increased without increasing the withstanding voltage, it is necessary to lower one of the potentials, either the potential to be applied for making the toner jump (to be referred to hereinbelow as the ON potential) or the potential to be applied for prohibiting the toner from jumping (to be referred to hereinbelow as OFF potential). If the OFF potential is set higher, the ON potential must be decreased, resulting in insufficiency of toner transfer and hence producing a blurred image without contrast. On the other hand, if the ON potential is set higher, the OFF potential must be decreased. In this case, the stoppage of the jumping of the toner cannot be correctly achieved, causing background fogginess and hence making it difficult to produce a good image with correct contrast. In the case of a color image forming apparatus, this defect causes insufficiency in reproduction of colors.

To deal with this, an attempt at varying the size of the electrode has been made in the aforementioned prior art. However, the toner supported on the toner support also jumps to areas other than the gates on the control electrode. Most of the toner having reached the control electrode will return to the toner support when the potential of the control electrode is switched. However, there is some toner which stays on the control electrode, and this remaining toner causes the apparent potential of the control electrode to vary, which would cause incorrect jumping of the toner.

Further, when toner has built up on the control electrode after toner jumping has been repeated, i.e., in a state where a large amount of toner is adhering to the control electrode, if the voltage for making the toner jump is applied to the control electrode, the toner particles jumping from the toner support will touch the toner adhering on the control electrode or collide with it. At this moment, if the cohesion between the toner particles is very strong, the toner particles may form an aggregation, clumping and remaining on the control electrode. Similarly, as further toner particles repeatedly jump and adhere to the toner aggregations staying on the control electrode, the aggregations finally build up covering the gates. A further buildup of adhering toner will reach and destroy the toner layer carried on the toner support surface. In this way, the gates become clogged and the state of the toner layer is disordered, causing difficulties in producing a good image or causing insufficiency in reproduction of colors in the case of a color image forming apparatus.

SUMMARY OF THE INVENTION

It is therefore an object of the present invention to provide a compact, low-priced, highly reliable image forming apparatus which can produce high-quality images with high contrast and free from density fluctuation by modifying the shapes and control methods of the toner support, control electrode, opposing electrode etc.

In order to achieve the above object, the present invention is configured as follows:

In accordance with the first aspect of the invention, an image forming apparatus comprises:

- a supplying means at least having a developer support carrying one color of developer;
- an opposing electrode disposed facing the developer support;
- a control electrode at least comprising:
  - an insulative substrate disposed between the developer support and the opposing electrode;
  - a plurality of gates formed in the insulative substrate for forming the passage of the developer;
  - one or more electrode groups provided covering a multiple number of the gates; and a shield electrode having one or more electrode elements each having openings which directly or electrically expose at least part of gates and the electrode groups with the gates to the developer support;

a control means having a control circuit means which is able to apply a predetermined voltage to each electrode on the control electrode in accordance with the image data, wherein the control means controls the passage of the developer through gates by applying the designated voltage to the corresponding electrodes of the electrode groups so as to form an image on the surface of a recording medium which is being conveyed between the control electrode and the opposing electrode, and is characterized in that the degree of exposure (including electrical exposure) of an arbitrary one of gates or electrode groups disposed around the gates, to the developer carried on the developer support is controlled by shield electrode.

In accordance with the second aspect of the invention, the image forming apparatus having the above first feature is characterized in that the degree of exposure (including electrical exposure) of an arbitrary one of gates or the electrode groups disposed around the gates, to the developer carried on the developer support is controlled by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group.

In accordance with the third aspect of the invention, the image forming apparatus having the above first feature is characterized that the degree of exposure (including electrical exposure) of an arbitrary one of the gates or the electrode groups disposed around the gates, to the developer carried on the developer support is controlled by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group, and the degree of exposure is made different for each gate or each electrode group.

In accordance with the fourth aspect of the invention, the image forming apparatus having the above first feature is characterized in that the control means or the supplying means includes a detecting means for detecting the characteristics of the developer or the characteristic values of the developer being carried on the developer support, comparing the detected characteristic values of the developer with the predetermined developer characteristics and outputting the detected values, and based on the detected values, the control means controls the degree of exposure by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group so as to perform individual control for each gate or identical control for a plurality of gates.

In accordance with the fifth aspect of the invention, the image forming apparatus having the above first feature is characterized in that the degree of exposure which is controlled by governing at least one or combination of the positional relationship of the shield electrode relative to the developer support and the electrode groups, the relative potential difference of the shield electrode relative to the developer support and the electrode group and the ratio of the exposed portion of the shield electrode to that of the electrode group, is controlled so as to vary in accordance with the distance between the gate and the developer or the strength of the electric field generated by the control means, and individual control is performed for each gate or identical control is performed for a plurality of gates.

In accordance with the sixth aspect of the invention, the image forming apparatus having the above first feature is characterized in that the degree of exposure which is controlled by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group is controlled so as to vary in accordance with the distance between the gate and the developer or the strength of the electric field generated by the control means, and individual control is performed for each gate or identical control is performed for a plurality of gates while the control of the degree of exposure of a gate or the electrode disposed with the gate at least includes control based on the size of the electrode and the size of the opening formed in the shield electrode.

In accordance with the seventh aspect of the invention, the image forming apparatus having the above first feature comprises:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming the passage of the developer;

one or more electrode groups provided covering a multiple number of the gates; and a first shield electrode disposed between the electrode groups and the opposing electrode and having one or more electrode elements each having openings which directly or electrically expose at least part of gates and the electrode groups with the gates, to the developer support; and a second shield electrode disposed between the electrode groups and the opposing electrode and having one or more electrode elements each having openings which directly or electrically expose at least part of gates and the electrode groups with the gates, to the developer support; and a control means having a control circuit means which is able to apply a predetermined voltage to each electrode on the control electrode in accordance with the image data, wherein the control means controls the passage of the developer through gates by applying the designated voltage to the corresponding electrodes of the electrode groups so as to form an image on the surface of a recording medium which is being conveyed between the control electrode and the opposing electrode, and is characterized in that the degree of exposure (including electrical exposure) of an arbitrary one of gates or electrode groups disposed around gates, to the developer carried on the developer support is controlled by the first or the second shield electrode or combined function of the first and second shield electrodes.

In accordance with the eighth aspect of the invention, the image forming apparatus having the above first feature is characterized in that the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

In accordance with the ninth aspect of the invention, the image forming apparatus having the above second feature is characterized in that the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

In accordance with the tenth aspect of the invention, the image forming apparatus having the above third feature is characterized in that the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

In accordance with the eleventh aspect of the invention, the image forming apparatus having the above fourth feature is characterized in that the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

In accordance with the twelfth aspect of the invention, the image forming apparatus having the above fifth feature is characterized in that the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

In accordance with the thirteenth aspect of the invention, the image forming apparatus having the above sixth feature is characterized in that the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

In accordance with the fourteenth aspect of the invention, the image forming apparatus having the above seventh feature is characterized in that the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

In accordance with the fifteenth aspect of the invention, the image forming apparatus having any one of the above first through fourteenth features is characterized in that the control by the shield electrode is further characterized in that the degrees of electrical exposure of the electrode groups are set greater as they are positioned more downstream with respect to the direction of conveyance of the developer supported on the developer support.

As has been described, in the present invention, the degrees of exposure of the electrode groups, including the degree of electrical exposure, to the toner support or the toner supported on the toner support are adjusted by the shield electrode, so that the jumping of the toner can be easily controlled and uniformly obtained in a desired way. Accordingly, it becomes possible to produce a good image. Further, since the configuration of the invention does not use the voltage for determining whether the toner is caused to jump or not, which would be used in order to stabilize the jumping of the toner, there is no need to provide a voltage switching means etc. In the present invention, the shapes and control methods of the toner support, the control electrode and the opposing electrode etc. are improved whereby it becomes possible to achieve fine and uniform toner transfer control, thus realizing a highly qualified images with correct contrast and free from fluctuation in density.

DESCRIPTION OF THE PREFERRED EMBODIMENTS

Embodiments of the invention will hereinafter be described in detail with reference to FIGS. 1 through 27.

Figure 1:
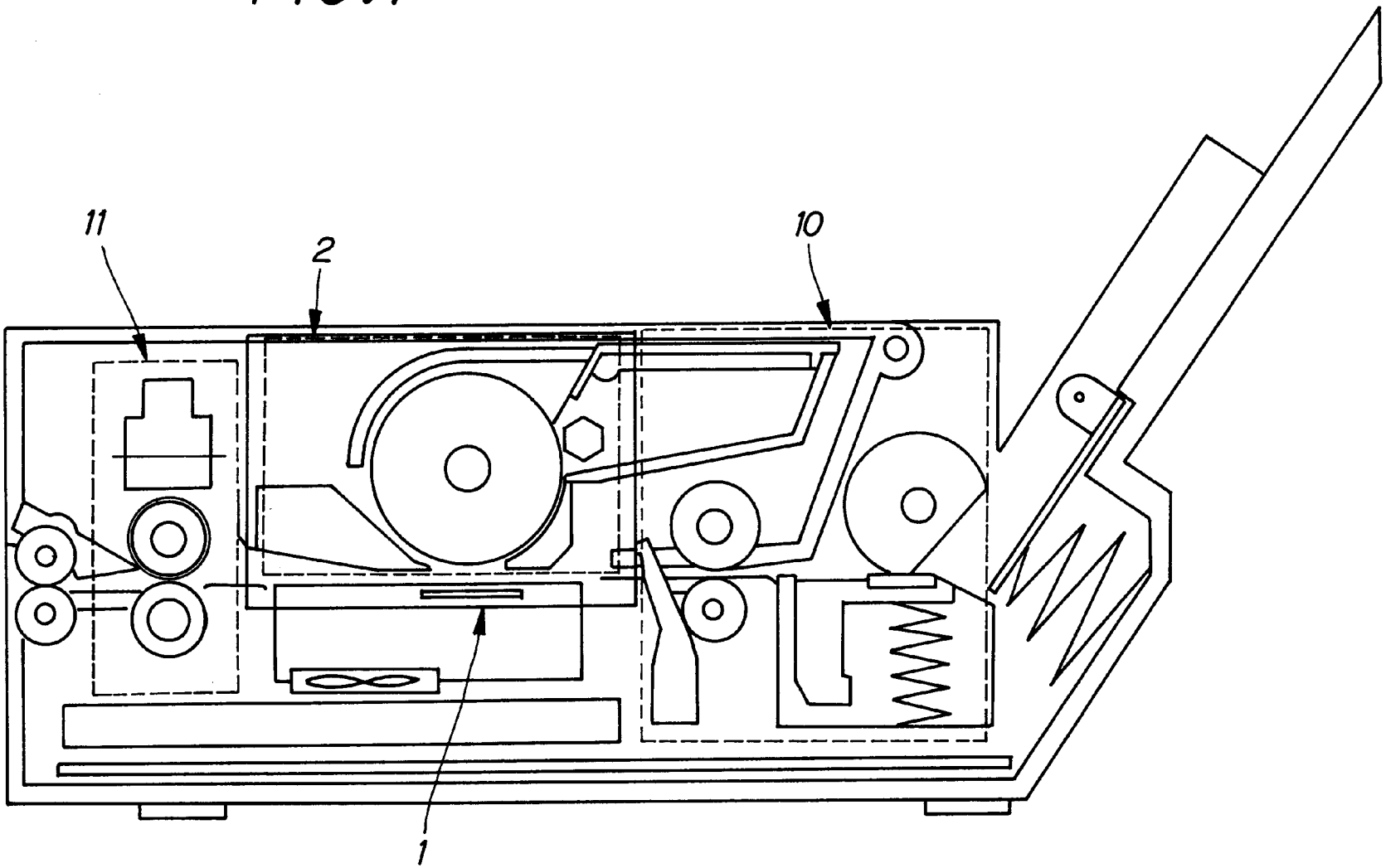
FIG. 1 is a sectional view showing an image forming apparatus in accordance with the invention.

FIG. 1 is a sectional view showing an image forming apparatus in accordance with the invention and this configuration includes an image forming unit 1, a toner supplying section 2, a paper feeder 10 and a fixing unit 11. This components will hereinbelow be detailed with reference to FIG. 2. In the following description, an image forming apparatus with a configuration for negatively charged toner will be described, but the polarity of each voltage to be applied may be appropriately set if positive charged toner is used.

Figure 2:
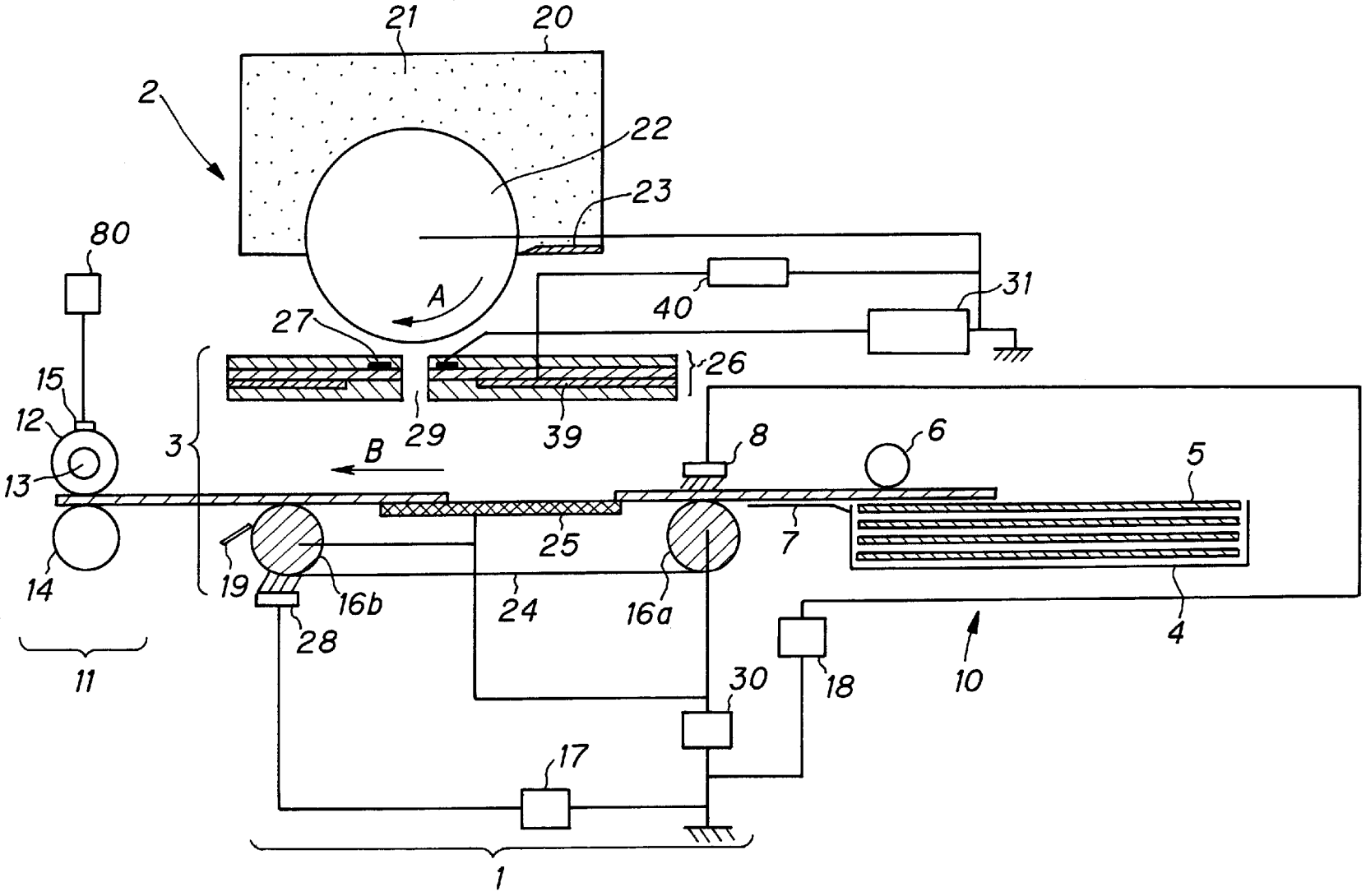
FIG. 2 is a schematic sectional view showing the embodiment of an image forming apparatus in accordance with the invention.

As shown in FIG. 2, image forming unit 1 has toner supplying section 2 and printer section 3, and produces, in accordance with an image signal, a visual image on a sheet of paper 5 as the recording medium, using toner as the developer. That is, the image forming apparatus of the invention causes the toner to jump and adhere onto paper 5 whilst the jumping of the toner is being controlled based on the image signal, to thereby create an image directly, on paper 5.

Paper feeder 10 is provided on the input side of image forming unit 1 to which the paper is fed. Paper feeder 10 is composed of a paper cassette 4 for storing paper 5 as the recording medium, a pickup roller 6 for delivering paper 5 from paper cassette 4, and a paper guide 7 for guiding fed paper 5. Paper feeder 10 further has unillustrated detecting sensors for detecting the feed of paper 5. Pickup roller 6 is rotationally driven by an unillustrated driving means.

Provided on the output side of image forming unit 1 from which the paper is output, is a fixing unit 11 for heating and pressing the toner image which was formed on paper 5 through the image forming unit 1, to fix it onto paper 5. Fixing unit 11 is composed of a heat roller 12, a heater 13, a pressing roller 14, a temperature sensor 15, and a temperature controller circuit 80. Heat roller 12 is made up of, for example, an aluminum pipe of 2 mm thick. Heater 13 is a halogen lamp, for example, which is incorporated in heat roller 12. Pressing roller 14 is made of e.g., silicone resin. Heat roller 12 and pressing roller 14 which are arranged opposite to each other, are pressed against one another in order to hold paper 5 in between and press it, with a pressing load, e.g. 2 kg, from unillustrated springs etc., provided at both ends of their shafts.

Temperature sensor 15 measures the surface temperature of heat roller 12. Temperature controller circuit 80 is controlled by a main controller (not shown) which performs the on/off control of heater 13 and other control based on the measurement of temperature sensor 15, thus maintaining the surface temperature of heater roller 12 at, for example, 150 ° C. Fixing unit 11 has an unillustrated paper discharge sensor for detecting the discharge of paper 5. The materials of heat roller 12, heater 13, pressing roller 14, etc., are not specifically limited. Further, fixing unit 11 may use a fixing configuration in which paper 5 is heated or pressed only to fix the toner image.

Further, although it is not shown in the drawing, provided on the output side of paper 5 from fixing unit 11 are a paper discharge roller for discharging paper 5 processed through fixing unit 11 onto a paper output tray and a paper output tray for holding paper 5 thus discharged. The aforementioned heat roller 12, pressing roller 14 and the paper discharge roller are rotated by an unillustrated driving means.

Toner supplying section 2 in image forming unit 1 is composed of a toner storage tank 20 for storing toner 21 as the developer, a toner support 22 of a cylindrical sleeve for magnetically supporting toner 21 and a doctor blade 23 which is provided inside toner storage tank 20 to electrify toner 21 and regulate the thickness of the toner layer carried on the peripheral surface of toner support 22.

Doctor blade 23 is arranged on the upstream side of toner support 22 with respect to the rotational direction thereof, spaced with a distance of about 60 um, for example, from the peripheral surface of toner support 22. Toner 21 is of a magnetic type having a mean particle diameter of, for example, 6 $\mu$m, and is electrified with static charge of −4 $\mu$C/g to −5 $\mu$C/g by doctor blade 23. Here, the distance between doctor blade 23 and toner support 22 is not particularly limited. Also the mean particle size, the amount of static charge, etc., of toner 21 are not particularly limited.

Toner support 22 is rotationally driven by an unillustrated driving means in the direction indicated by arrow A in FIG. 2, with its surface speed set at 80 mm/sec, for example. Toner support 22 is grounded and has unillustrated magnets arranged therein, at the position opposite doctor blade 23 and at the position opposite a control electrode 26. This arrangement permits toner support 22 to carry toner 21 on its peripheral surface. Toner 21 supported on the peripheral surface of toner support 22 is made to stand up in 'spikes' at the area facing control electrode 26. Rotating speed of toner support 22 is not particularly limited. Here, the toner is supported by magnetic force, but toner support 22 can be configured so as to support toner 21 by electric force or combination of electric and magnetic forces.

Printing section 3 in image forming unit 1 includes: an opposing electrode 25 which is made up of an aluminum sheet of, for example, 1 mm thick and faces the peripheral surface of toner support 22; a high-voltage power source 30 for supplying a high voltage to opposing electrode 25; a control electrode 26 provided between opposing electrode 25 and toner support 22; a charge erasing brush 28; a charge erasing power source 17 for applying a charge erasing voltage to charge erasing brush 28; a charging brush 8 for charging a sheet of paper 5; a charger power source 18 for supplying a charger voltage to charging brush 8; a dielectric belt 24; support rollers 16*a* and 16*b* for supporting dielectric belt 24; and a cleaner blade 19. Opposing electrode 25 is arranged e.g., 1.1 mm apart from the peripheral surface of toner support 22. Dielectric belt 24 is made of PVDF as a base material, and is 75 μm thick with a volume resistivity of $10^{10}\Omega\cdot$cm. Dielectric belt 24 is rotated by an unillustrated driving means in the direction of arrow B, at a surface speed of 30 mm/sec.

Applied to opposing electrode 25 is a high voltage, e.g., 2.3 kV from high voltage power source 30. The voltage supplied from high voltage power source 30 generates an electric field between opposing electrode 25 and toner support 22, required for causing toner 21 being supported on toner support 22 to jump toward opposing electrode 25.

Charge erasing brush 28 is pressed against dielectric belt 24 at a position downstream, relative to the rotational direction of dielectric belt 24, and of control electrode 26. Charge erasing brush 28 has an erasing potential of 2.5 kV applied from charge erasing power source 17 so as to eliminate unnecessary charges remaining on the surface of dielectric belt 24. If some toner 21 adhered to the surface of dielectric belt 24 due to a contingency such as paper jam, etc., cleaning blade 19 removes this toner 21 to prevent staining by toner 21 on the paper underside.

The material of opposing electrode 25 is not particularly limited. The distance between opposing electrode 25 and toner support 22 is not particularly specified either. Further, the rotational speed of opposing electrode 25 or the voltage to be applied thereto is not particularly limited either.

Although unillustrated, the present image forming apparatus includes: a main controller as a control circuit for controlling the whole image forming apparatus; an image processor for converting the obtained image data into a format of image data to be printed; an image memory for storage of the converted image data; and an image forming control unit for converting the image data obtained from the image processor into the image data to be given to control electrode 26.

Control electrode 26 is disposed in parallel to opposing electrode 25 and spreads two-dimensionally facing opposing electrode 25, and it has a structure to permit the toner 21 to pass therethrough from toner support 22 to opposing electrode 25. The electric field formed around the surface of toner support 22 varies depending on the potential being applied to control electrode 26, so that the jumping of toner 21 from toner support 22 to opposing electrode 25 is controlled. Control electrode 26 is arranged so that its distance from the peripheral surface of toner support 22 is set at 100 μm, for example, and is secured by means of an unillustrated supporter member.

Figure 3:
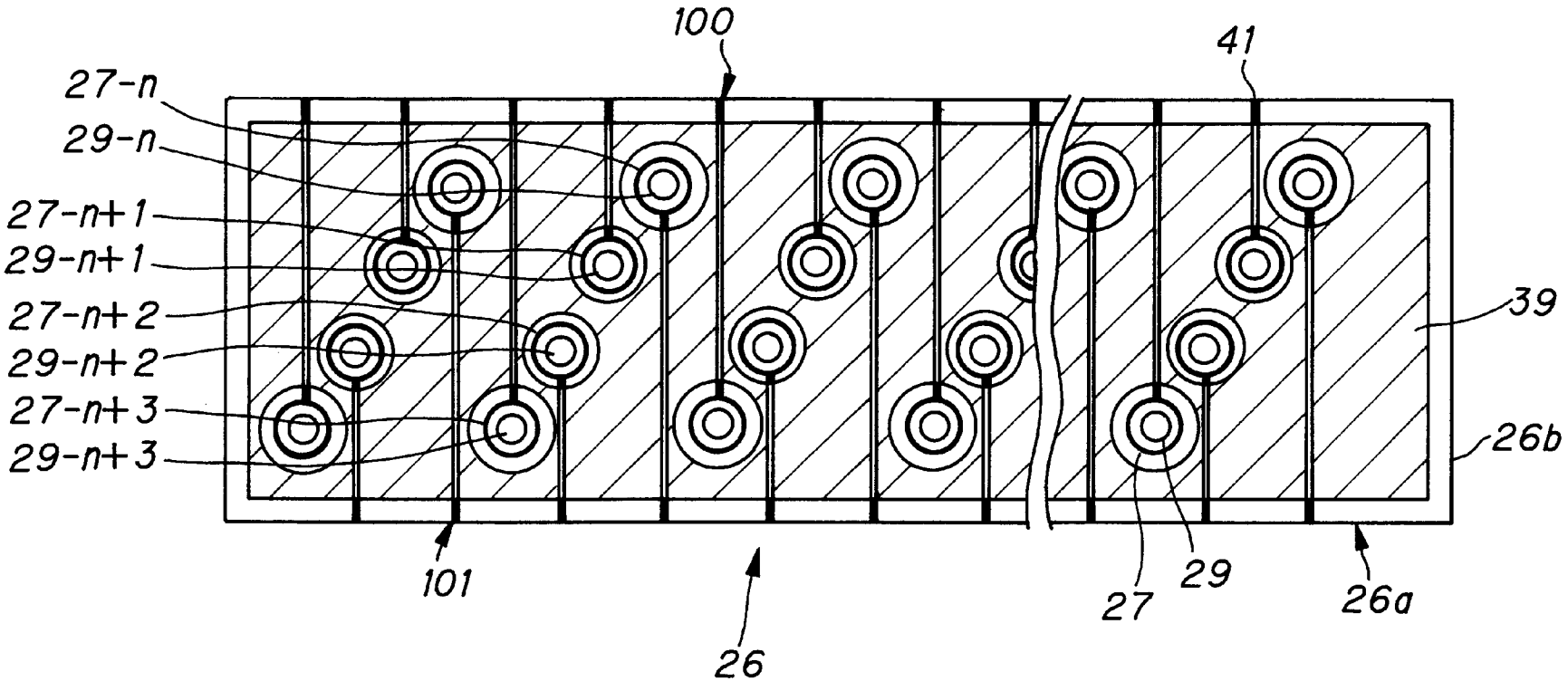
FIG. 3 is a view for illustrating a control electrode.

FIG. 3 is a view for illustrating control electrode 26. Control electrode 26 is composed of an insulative board 26*a*, a high voltage driver (not shown), annular conductors independent of one another, i.e., annular electrodes 27. Board 26*a* is made from a polyimide resin, for example, with a thickness of 25 μm. Board 26*a* further has holes forming gates 29, to be mentioned later. Annular electrodes 27 are formed of copper foil of e.g., 18 μm thick and are arranged around the holes, in a predetermined layout. Each opening of gate 29 is formed with a diameter of 160 μm, for example, forming a passage for toner 21 to jump from toner support 22 to opposing electrode 25 therethrough. Here, the distance between control electrode 26 and toner support 22 is not particularly limited.

Further, as shown in FIG. 2, a shield electrode 39 made up of copper foil of 18 μm thick with openings (having an aftermentioned opening diameter) at positions corresponding to gates 29 is provided for control electrode 26 on its side facing opposing electrode 25.

Gates 29 or the holes in annular electrodes 27 are formed at, for example, 2,560 sites. Each annular electrode 27 is electrically connected to a control power source 31 shown in FIG. 2 via feeder line 41 and a high voltage driver (not shown). The number of annular electrodes 27 is not particular limited. The size of gate 29 and the materials and thickness of board 26*a* and annular electrodes 27 are not particularly limited.

The surface of the shield electrode, the surface of annular electrodes 27 and the surface of feeder lines 41 are covered with an insulative layer 26*b* of 30 μm thick, which ensures insulation between annular electrodes 27, insulation between feeder lines 41, insulation between annular electrodes 27 and feeder lines 41 which are not connected with each other, insulation from toner support 22 and insulation from opposing electrode 25. The material, thickness etc., of the insulative layer are not particularly limited.

Supplied to annular electrodes 27 of control electrode 26 are voltages or pulses in accordance with the image signal from control power source 31 shown in FIG. 2. Specifically, when toner 21 carried on toner support 22 is made to pass toward opposing electrode 25, a voltage, e.g., 150 V is applied from the control power source 31 to annular electrodes 27. When the toner is blocked from passing, a voltage, e.g., −200 V is applied. Supplied to shield electrode 39 provided for control electrode 26 is a shield voltage of −20 V from a shield voltage power source 40. This shield voltage is effective in preventing toner 21 from adhering to control electrode 26 and in removing toner 21 adhering to control electrode 26 from a position of toner support 22.

In this way, whilst the potential to be imparted to control electrode 26 is controlled in accordance with the image signal, a sheet of paper 5 is fed over opposing electrode 25 on the side thereof facing toner support 22. Thus, a toner image is formed on the surface of paper 5 in accordance with the image signal. Here, control power source 31 is controlled by a control electrode controlling signal transmitted from an unillustrated image forming control unit.

The above image forming apparatus can be applied to an output printer for computers, word processors as well as the printing portion of digital copiers.

Figure 4:
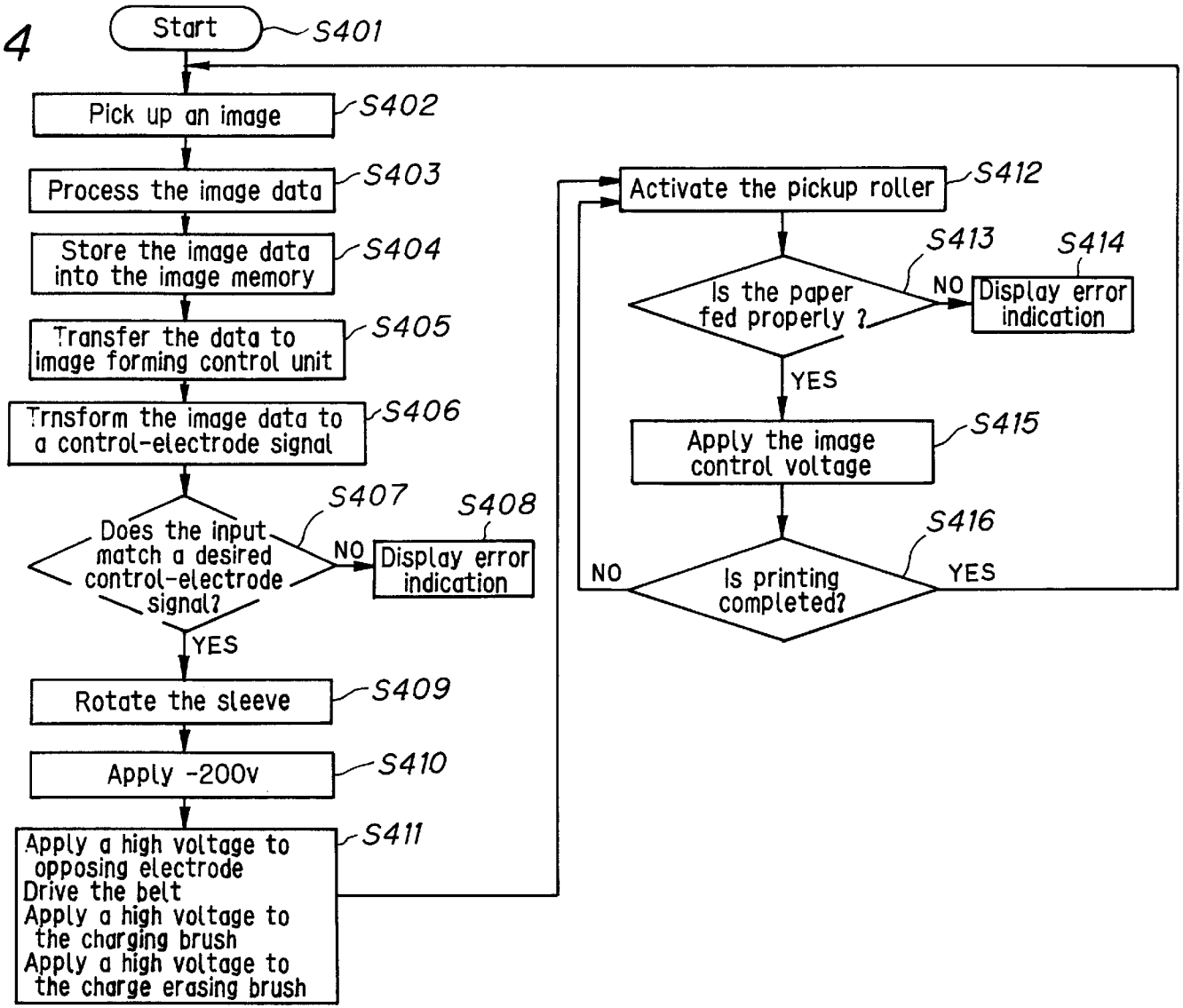
FIG. 4 is a flowchart for explaining the image forming operation.

Referring next to FIG. 4, description will be made of a case of the apparatus which is used for the printing portion of a digital copier.

First, when the user operates the copy start key with an original to be copied set on the image pickup section (Step S401), the main controller, in response to the input operation, starts the image forming operation. Specifically, the image pickup section reads the image from the original (Step S402), and the image data is processed in the image processing section (Step S403) to be stored into the image memory (Step S404). The image data stored in the image memory is transferred to the image forming control unit (Step S405). In the image forming control unit, the image data thus input is converted into a control electrode controlling signal to be provided to control electrode 26 (Step S406).

The image forming control unit judges whether it acquires a predetermined amount of the control electrode control signal (Step S407). When the input does not match the predetermined amount, the operation will be stopped with an error indication displayed (Step S408). When the input matches the predetermined amount, toner support 22 is started to rotate (Step S409) and a voltage of −200 V is applied to annular electrodes 27 of control electrode 26 so that toner 21 will not pass therethrough (Step S410). Next, a high voltage is applied to opposing electrode 25 and dielectric belt 24 starts to be driven with predetermined voltages applied to charging brush 8 and charge erasing brush 28, respectively (Step S411).

Thereafter, an unillustrated driver is activated to rotate pickup roller 6, which starts feed of a sheet of paper 5 (Step S412). At that moment, at Step S413, it is judged by detecting sensors whether the paper is fed correctly or not. When the paper is fed in an improper manner, the operation is stopped with an error displayed (Step S414). When the paper is fed correctly, the image control voltage is applied to annular electrodes 27 of control electrode 26 to thereby start printing (Step S415). At Step S416, it is judged whether the printing is ended. When the printing is continued, the operation returns to Step S412 to repeat the subsequent printing operation. When the printing is stopped, the operation returns to Step S401 and the next instruction of start will be waited for.

In the above flow of operation, paper 5 delivered out by pickup roller 6 at Step S412 is conveyed between charging brush 8 and support member 16*a*. Support member 16*a* is applied at a voltage equal to the potential of opposing electrode 25 by high voltage power source 30. Charging brush 8 is applied with 1.2 kV as the charging potential by charger power source 18. Paper 5 is supplied with charge due to the potential difference between charging brush 8 and support member 16*a*. Electrostatically attracted to dielectric belt 24, the paper is conveyed with the advance of the belt, to a position in printing section 3 of image forming unit 1, where dielectric belt 24 faces toner support 22. The aforementioned amount of the control electrode controlling signal may be different depending on the configuration etc. of the image forming apparatus used.

At Step S406, the image forming control unit supplies the control electrode controlling signal converted from the image data, to control power source 31. This control electrode controlling signal is supplied at a time synchronized with the delivery of paper 5 from charging brush 8 to printing section 3. Control power source 31 controls the high voltage to be applied to annular electrodes 27 of control electrode 26 at Step S415, based on the control electrode controlling signal. Illustratively, the voltage of 150 V or −200 V is applied as appropriate to selected annular electrodes 27 from control power source 31 so as to control the electric field around control electrode 26. Accordingly, at each gate 29 of control electrode 26, the jumping of toner 21 from toner support 22 toward opposing electrode 25 is prevented or permitted as appropriate, in accordance with the image data. Thus, a toner image in conformity with the image signal is formed on paper 5 which is moving at the rate of 30 mm/sec toward the paper output side by the advance of dielectric belt 24 over the surface of opposing electrode 25.

Paper 5 with the toner image formed thereon is conveyed to fixing unit 11, where the toner image is fixed to paper 5. Paper 5 with a toner image fixed thereon is discharged by the discharge roller onto the paper output tray. At the same time, the fact that the paper is normally discharged is detected by the paper discharge sensor. From this detecting operation, the main controller judges that the printing operation has been correctly completed. After the judgment of a correct completion of the operation, the next operation will be judged at Step S416.

By the image forming operation described above, a good image is created on paper 5. Since this image forming apparatus directly forms the image on paper 5, it is no longer necessary to use a developer medium such as photoreceptor, dielectric drum, etc., which were used in conventional image forming apparatuses. As a result, the transfer operation for transferring the image from the developer medium to paper 5 can be omitted, thus eliminating degradation of the image and improving the reliability of the apparatus. Since the configuration of the apparatus can be simplified needing fewer parts, it is possible to reduce the apparatus in size and cost.

The image forming apparatus of the above embodiment may be used as the printing portion of an output terminal for a computer or may be used as the printing portion of a digital copier. In either case, the method of the image forming operation itself has no difference from the other though the image signal to be processed and the way of processing differ in each case.

As stated already, toner support 22 is grounded while opposing electrode 25 and support member 16*a* have a high voltage of 2.3 kV applied and charging brush 8 has a high voltage of 1.2 kV applied. As a result, negative charge is supplied to the surface of paper 5 fed between charging brush 8 and dielectric belt 24, by the potential difference between charging brush 8 and support member 16*a*. As supplied with negative charge, paper 5 is attracted to dielectric belt 24 by the static electric force of the charge and is conveyed to directly below gates 29 as dielectric belt 24 moves. The charge on the surface of dielectric belt 24 dissipates, hence, when it reaches directly below gates 29 the paper will have a surface potential of 2 kV due to the equilibrium with the potential of opposing electrode 25.

In this condition, in order for toner 21 carried on toner support 22 to pass toward opposing electrode 25, control power source 31 is adapted to apply a voltage of 150 V to annular electrodes 27 of control electrode 26. When toner 21 needs to be stopped passing through gates 29, a voltage of −200 V is applied. In this way, with paper 5 being attracted to dielectric belt 24, the image is directly formed on the surface of paper 5.

In the above description, the voltage applied to annular electrodes 27 of control electrode 26 for allowing passage of toner 21 was set at 150 V as an example. This voltage, however, is not specifically limited as long as toner 21 can be caused to jump as desired. Similarly, the voltage applied to opposing electrode 25, the voltage applied to charging brush 8 and the surface potential of paper 5 directly below gates 29 are not particularly limited as long as toner 21 can be caused to jump as desired. Further, the voltage to be imparted to annular electrodes 27 of control electrode 26 to allow or stop the passage of toner 21 should not be particularly limited without departing from the scope of the main features of the invention.

Figure 5:
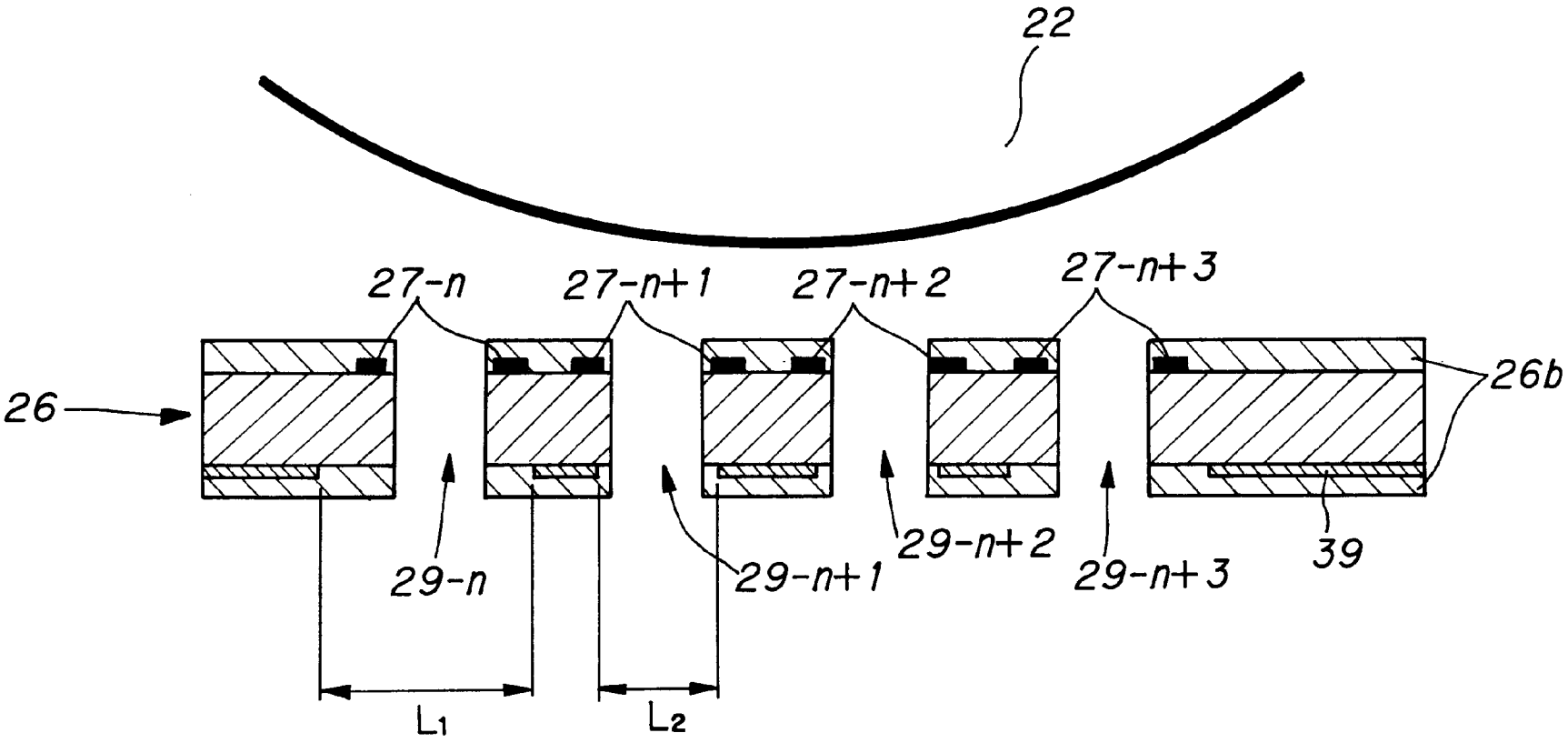
FIG. 5 is a sectional view for explaining the configuration of a control electrode.

Next, referring to FIG. 5, the configuration of control electrode 26 used in the above embodiment will be described. FIG. 5 is a sectional view of control electrode 26 shown in FIG. 3, cut on a line 100–101 therein.

As seen in FIG. 5, the diameters of openings in shield electrode 39 of control electrode 26 are different from one another depending upon the distance between toner support 22 and control electrode 26. For example, openings with a diameter $L_1$ of 300 $\mu$m are provided around gates 29-n and 29-n+3; openings with a diameter $L_2$ of 220 $\mu$m are provided around gates 29-n+1 and 29-n+2. In the embodiment described above, it is possible to control the amount of toner 21 passing through a gate 29 when the diameter of the opening in shield electrode 39 is altered.

Now, referring to FIG. 6, the relationship between the opening diameter in shield electrode 39 and the jumping amount of toner 21 will be explained.

When the size of the opening in shield electrode 39 is made greater, the jumping amount of toner 21 increases and reaches an almost saturated level when the diameter of the opening is over 450 $\mu$m in this embodiment. On the other hand, as the size of the opening becomes smaller, the jumping amount of toner 21 decreases and the jumping will not occur when the diameter of the opening is below 160 $\mu$m. The chart in FIG. 6 is normalized so that the jumping amount of toner when the opening is 500 $\mu$m in diameter is taken to be 1.

The numerals, i.e., the specific size of the opening shown in FIG. 6, such as 160 $\mu$m below which toner transfer will not occur or 450 $\mu$m above which the jumping amount reaches a saturated level may be different depending upon the characteristics of toner 21 used, the state of toner 21 supported on toner support 22, the position and the opening size of annular electrode 27, the potentials and the like. Therefore, similar characteristics can be obtained when the relative position of shield electrode 39 to toner support 22 or annular electrodes 27, as well as the potential of shield electrode 39 are taken as variables.

Figure 6:
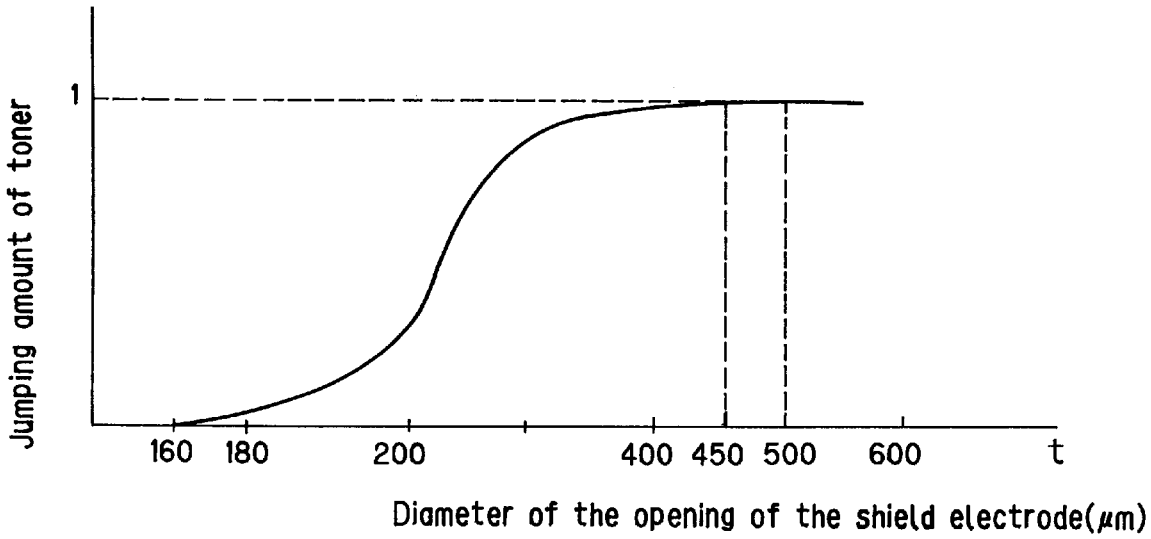
FIG. 6 is a chart for explaining the relationship between the diameter of an opening in the shield electrode and the jumping amount of toner.

The characteristics shown in FIG. 6 can be obtained by changing the position at which shield electrode 39 is formed, but the positioning needs a very high precision. Accordingly, if it is difficult to ensure a high enough precision for the positioning, control based on the size of the openings in shield electrode 39 or the control based on the voltage applied to shield electrode 39 is preferred. On the other hand, if it is possible to achieve high precision for positioning, a further fine and exact control can be performed by the above method combined with the control of the size of the openings and voltage control. Since the resultant effects of the parameters such as the size of the openings, the position and voltage of shield electrode 39 will differ depending upon the features of the image forming apparatus used, these parameters should be selected as appropriate.

In the aforementioned embodiment, as shown in FIG. 5, the degree of electrical exposure of each annular electrode 27 is varied in accordance with its distance from toner support 22. Illustratively, gates 29-n and 29-n+3 are located more distant from toner support 22 so that the diameters of the openings in shield electrode 39 are set greater. In other words the degrees of electrical exposure of annular electrodes 27-n and 27-n+3 are set high so as to enlarge the electric field forming area at toner support 22 thereby making a greater amount of toner 21 jump. On the other hand, gates 29-n+1 and 29-n+2 are located nearer to toner support 22, so the diameters of the openings in shield electrode 39 are set smaller. In other words the degrees of electrical exposure of annular electrodes 27-n and 27-n+3 are set low so as to reduce the electric field forming area at toner support 22 thereby reducing the jumping amount of toner 21 and ensuring the uniformity.

In the conventional configuration of the electrodes, an identical voltage was applied to each of annular electrodes 27, whatever the distance between gate 29 and toner support 22 was. Therefore, the electric fields formed at gates 29-n and 29-n+3 which are more distant from toner support 22, were weaker than that formed at gates 29-n+1 and 29-n+2, and the electric field forming area tended to become small. Accordingly, a high enough amount of toner 21 could not be caused to jump through gates 29-n and 29-n+3, thus making it difficult to produce an image with correct contrast and causing difficulties in reproducing an exact halftone image. Further, a density difference occurs between that at off-centered gates 29-n and 29-n+3 and that at centered gates 29-n+1 and 29-n+2, resulting in a poor reproduction of image.

On the other hand, if, in order to increase the image density produced by off-centered gates 29-n and 29-n+3, the voltage applied to the corresponding annular electrodes 27 was made higher to increase the amount of toner 21 passing through these gates, an excessive amount of toner 21 would transfer through centered gates 29-n+1 and 29-n+2. As a result, not only does the image become unnatural but also a larger amount of toner 21 than needed is consumed.

To deal with above problem, some attempts to alter the size of the electrodes have been made in the prior art. Any of such attempts, however, were not effective in the prior art when a shield electrode 39 was provided as in the embodiment, and further could not be expected to be effective in increasing the jumping amount of toner 21 without increasing the gauge or thickness of the electrodes.

In the prior art, toner 21 supported on toner support 22 also jumps to the surface on control electrode 26 in areas other than the areas of gates 29. Most of toner 21 having transferred to control electrode 26 will return to toner support 22 when the potential to control electrode 26 is switched. However, some toner 21 may remain adhering on control electrode 26. This remaining toner 21 causes the apparent potential of control electrode 26 to vary, making it impossible to achieve correct jumping of toner 21.

Furthermore, if toner adherence to control electrode 26 becomes worse, after repetitions of transfer of toner 21, or under the condition where a large amount of toner 21 remains adhering to control electrode 26, application of the voltage for causing toner 21 to jump to control electrode 26 causes toner 21 to jump from toner support 22 and hence touch, or collide against, the already adhering toner 21 on control electrode 26. At that moment, if the cohesion between the toner particles is very strong, the toner particles may form an aggregation, clumping and remaining on control electrode 26. Similarly, as toner 21 repeatedly jumps and adheres to the aggregations of toner 21 staying on control electrode 26, the aggregations finally build up covering gates 29. A further buildup of adhering toner 21 reaching the toner layer carried on the surface toner support 22, destroys the toner layer. In this way, gates 29 are clogged and the condition of the toner layer becomes varied, making it difficult to produce a good image.

To deal with the conventional problems described above, in the configuration of the present invention, the electric field forming region which is formed by the potential of any annular electrode 27 to allow toner 21 to jump therethrough is adjusted so as to make a desired, controlled amount of toner 21 jump through the corresponding gate 29. Therefore, toner 21 can pass uniformly and in the predetermined amount through every gate 29, thus forming a good image.

Figure 7:
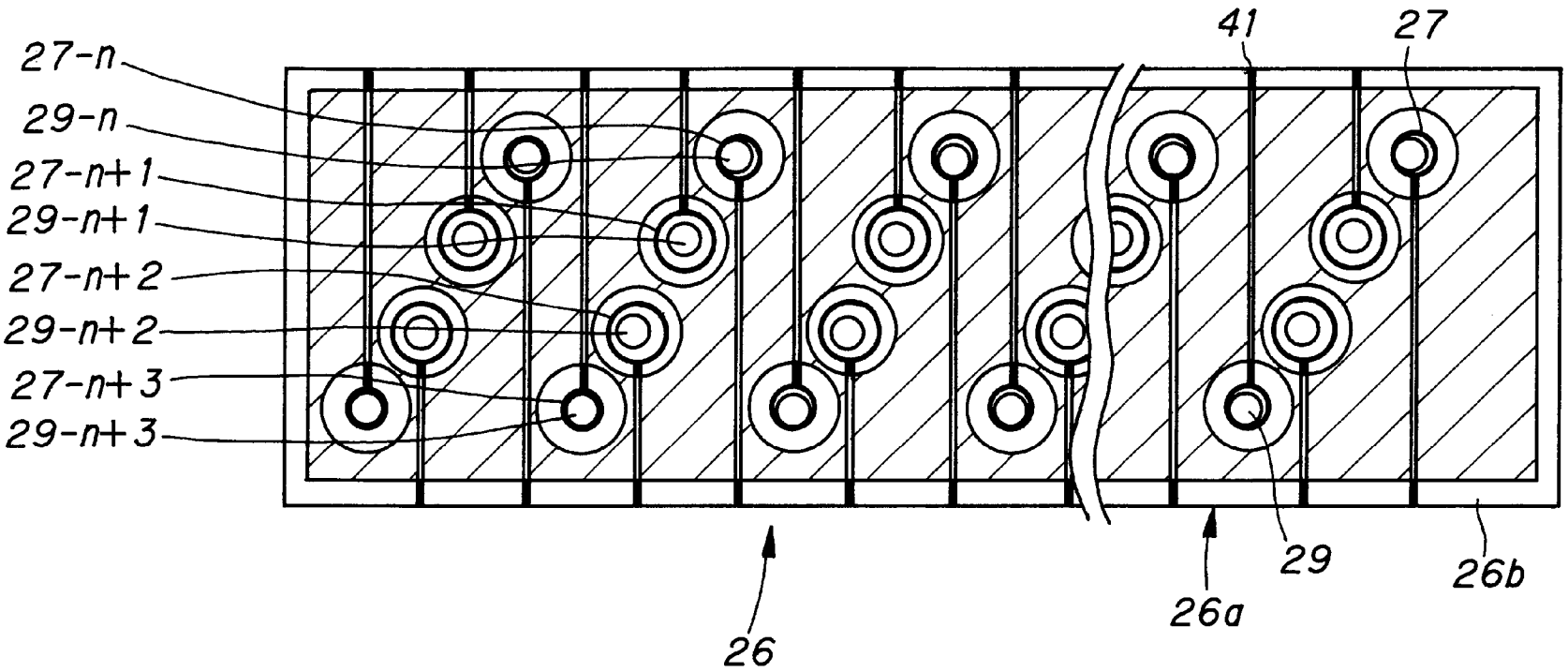
FIG. 7 is a view for illustrating another configuration of a control electrode.

FIG. 7 shows another embodiment of the invention. In this figure, the sizes of the openings in annular electrodes 27 are made different depending upon the distance between toner support 22 and control electrode 26. This arrangement makes the jumping amounts of toner 21 through off-centered gates 29-n and 29-n+3, and through centered gates 29-n+1 and 29-n+2 equal to each other. In this example, central annular electrodes 27-n+1 and 27-n+2 are greater in diameter. If, from the structural requirements, central annular electrodes 27 cannot be made large enough, it is possible to obtain the same effect by combination with a method of controlling the jumping amount of toner 21 by differentiating the diameters of the openings in shield electrode 39, as will be discussed later.

Figure 8:
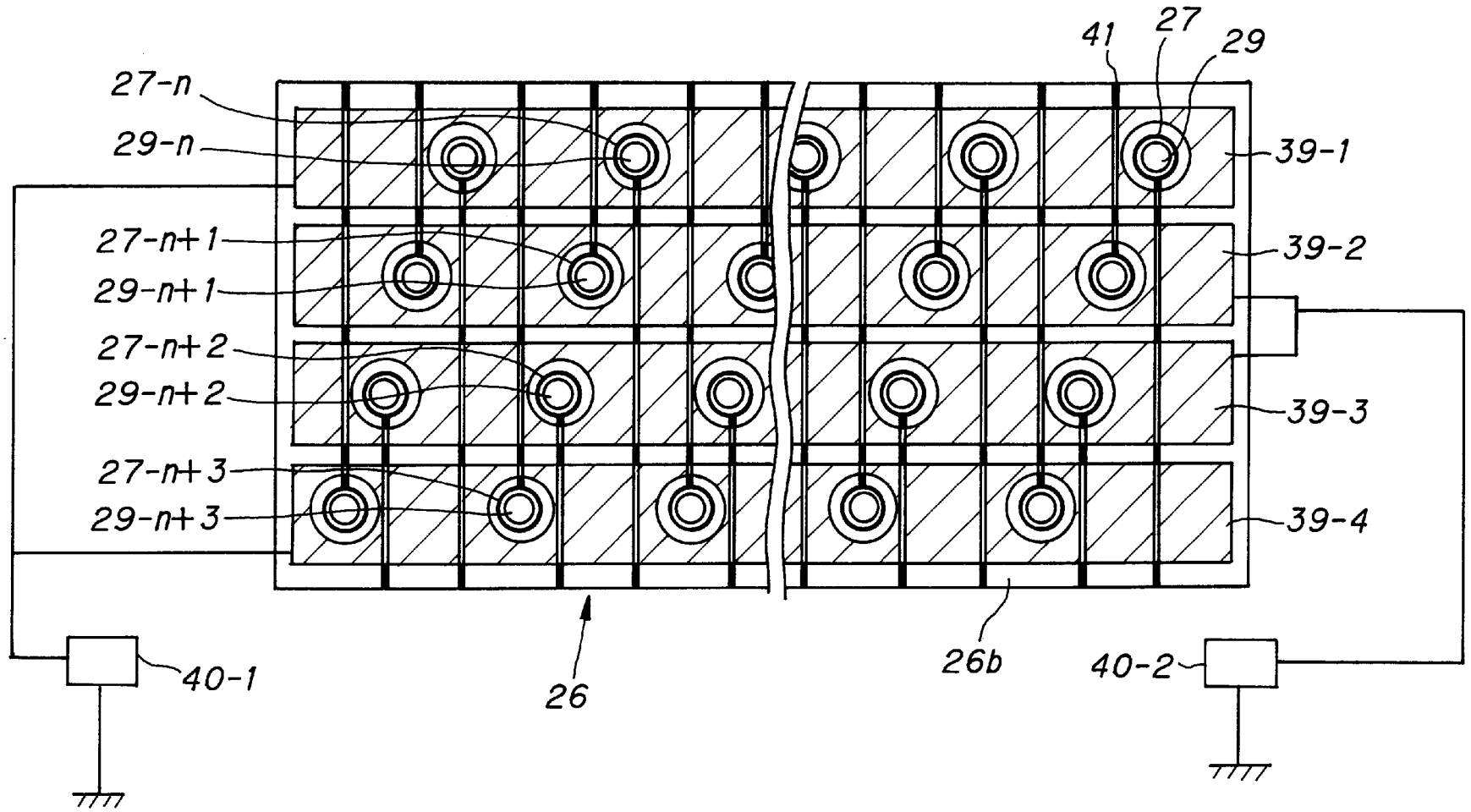
FIG. 8 is a view for illustrating another configuration of a control electrode.

FIG. 8 shows another embodiment of the invention. In this figure, shield electrode 39 of control electrode 26 is sectioned into shield electrode elements 39-1 to 39-4 depending upon the positional relationship between control electrode 26 and toner support 22. Further, shield electrode elements 39-1 and 39-4 are applied with −20 V from shield voltage power source 40-1 and shield electrode elements 39-2 and 39-3 are applied with −70 V from shield voltage power source 40-2. That is, dependent on the distance between toner support 22 and control electrode 26, the voltage to each of shield electrode elements 39 is made different from others, whereby the electric fields formed in the areas opposing off-centered gates 29-n and 29-n+3 and centered gates 29-n+1 and 29-n+2 are controlled so as to make the jumping amounts of toner through the off-centered and centered gates equal, forming a good image.

In the embodiment shown in FIG. 8, since a constant voltage is applied to all the annular electrodes 27, there is no need to provide any high withstanding voltage FETs, which would be needed for switching the voltage. When the difference in opening diameter between that of annular electrode 27 and that of shield electrode 39 is set to be small, very high precision is needed for positioning one to another. In this embodiment, however, the ratio of the opening diameter of the shield electrode 39 to that of annular electrode 27 can be set rather high, facilitating easy positioning.

Figure 9:
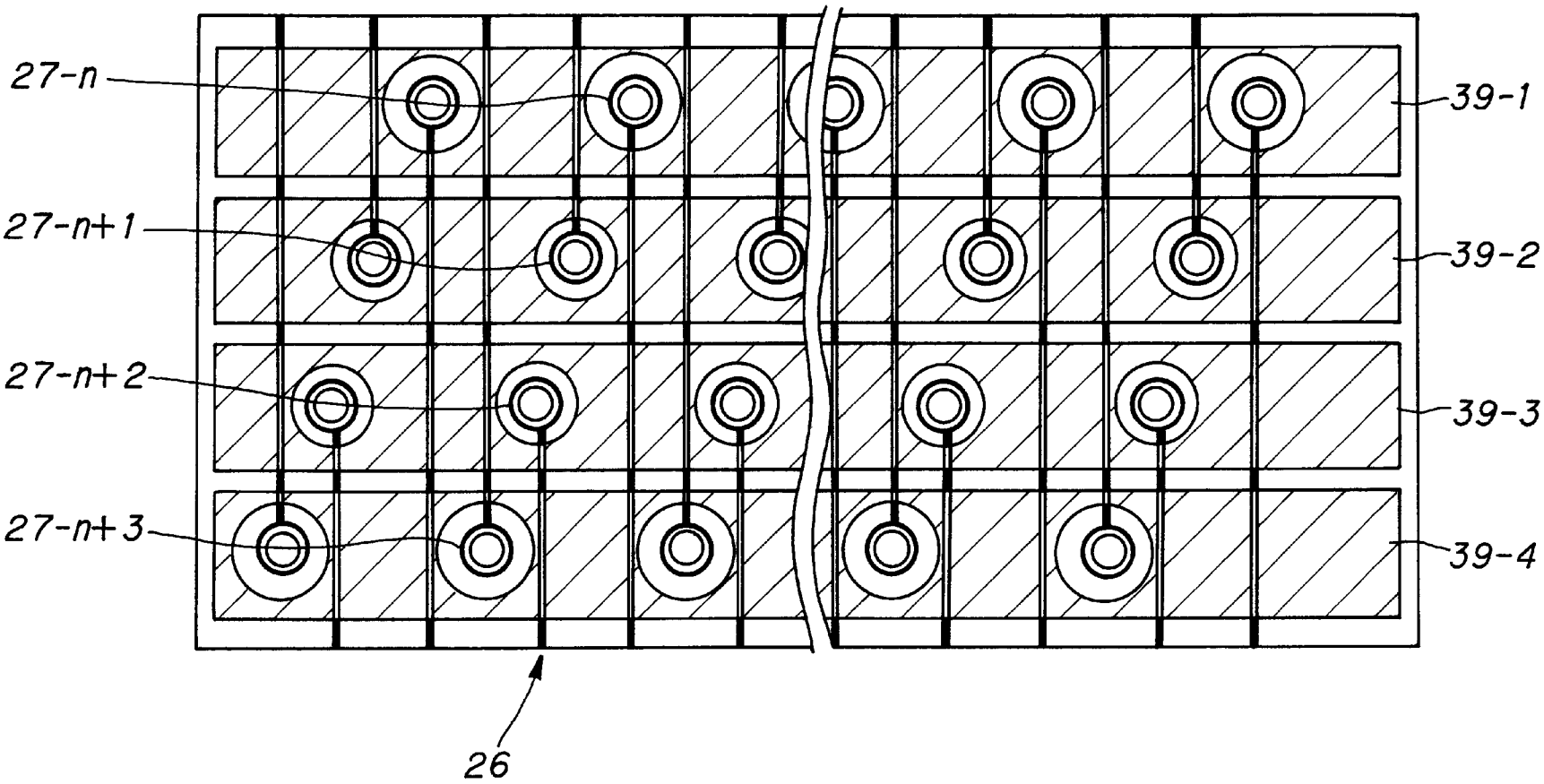
FIG. 9 is a view for illustrating another configuration of a control electrode.

FIG. 9 shows another embodiment of the invention. Shield electrode 39 is sectioned into four shield electrode elements 39-1 to 39-4 in the same manner as in FIG. 8. In this case, the diameters of the openings in shield electrode 39 are made different so as to vary the degree of exposure of annular electrodes 27-n to 27-n+3 to regulate the jumping of toner 21. Therefore, shield voltage power source 40 shown in FIG. 8 is not needed any longer.

Figure 10:
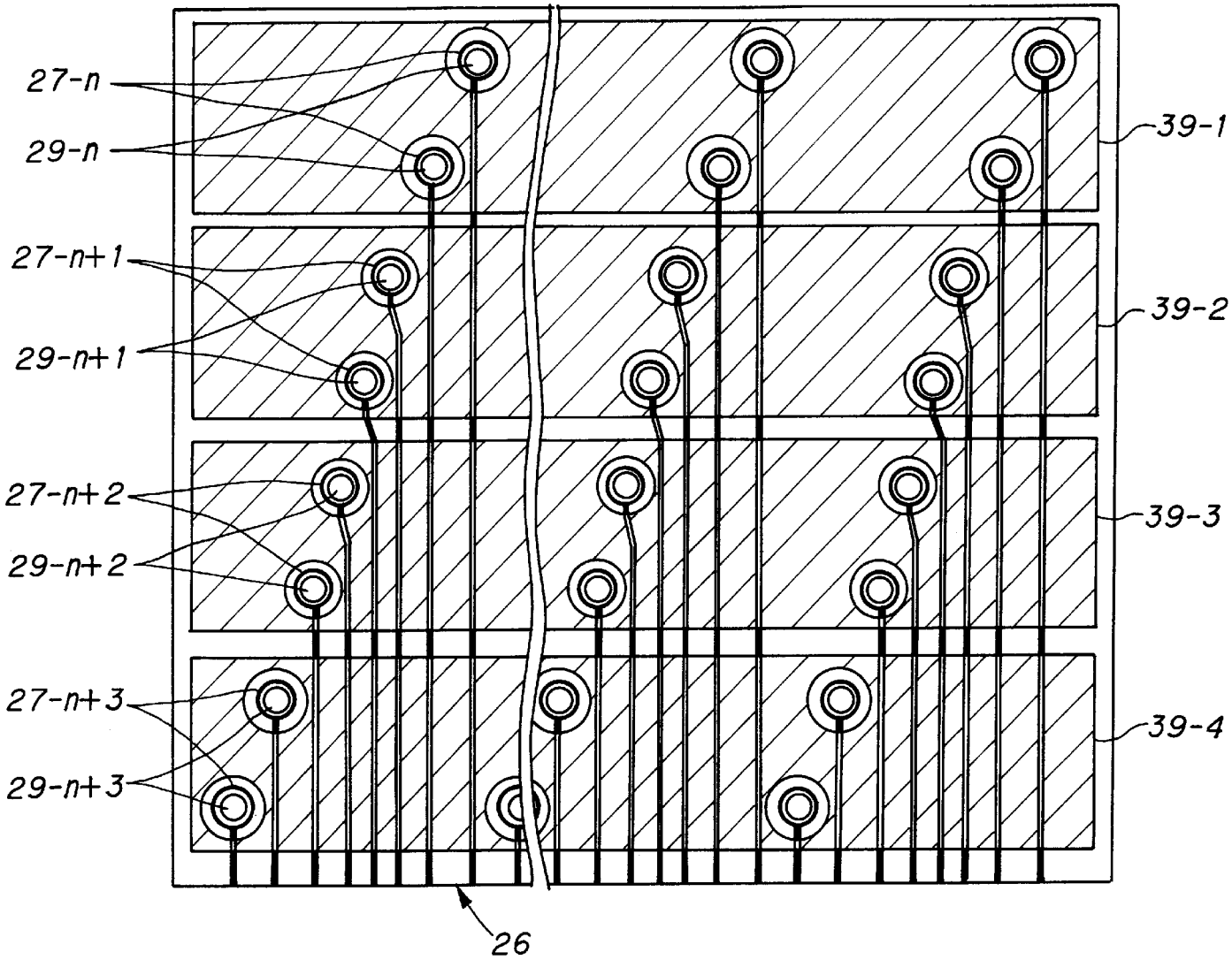
FIG. 10 is a view for illustrating another configuration of a control electrode.

FIG. 10 shows another embodiment of the invention, in which each of shield-electrode elements 39-1 to 39-4 has a multiple number of gates (29-n to 29-n+3), to thereby enable a more fine control of the jumping of toner 21.

Figure 11:
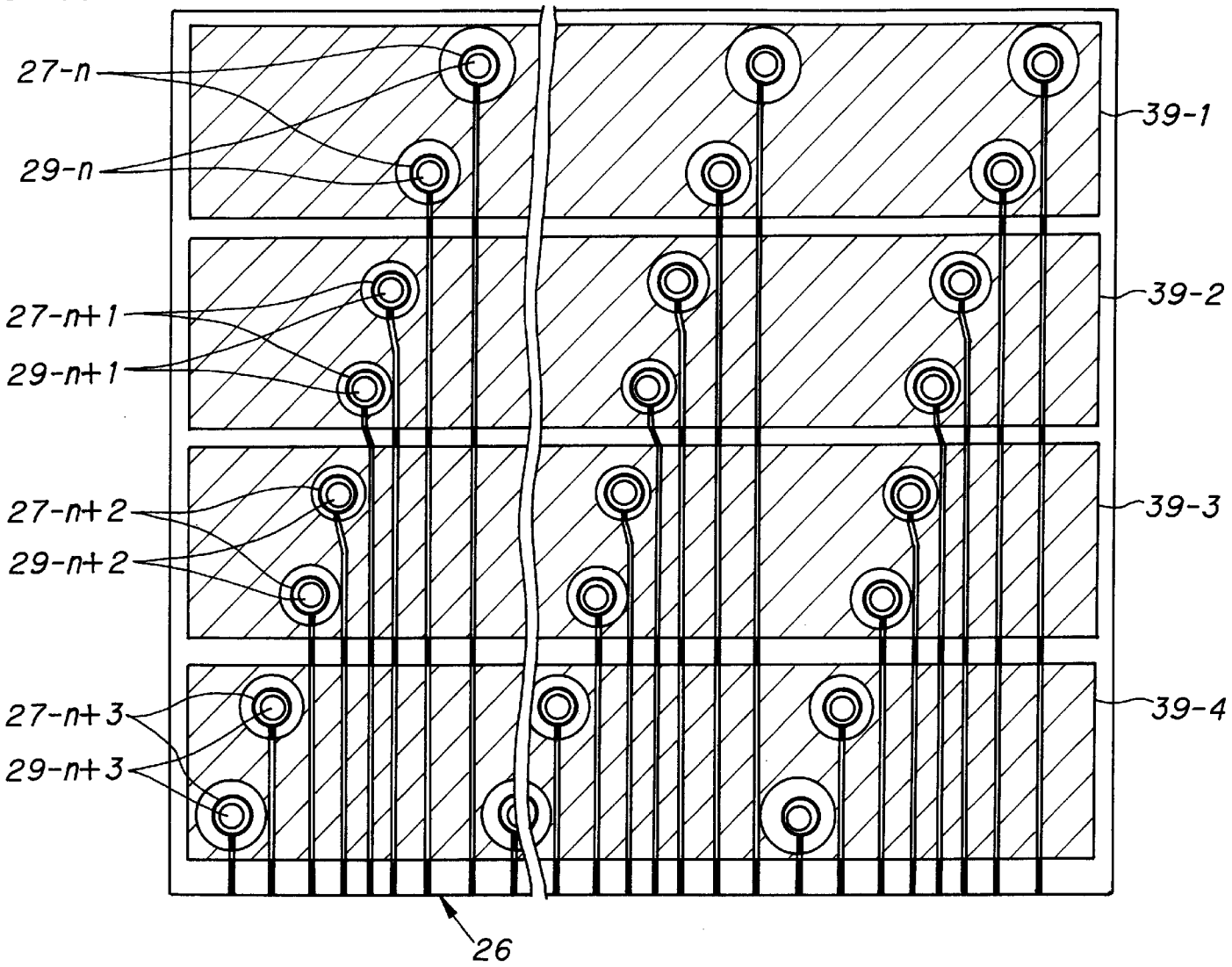
FIG. 11 is a view for illustrating another configuration of a control electrode.

FIG. 11 is another embodiment of the invention, in which the diameters of the openings around annular electrodes 27 in each of shield electrode elements 39 are made different. This configuration enables a further fine control of toner 21 than the configuration of FIG. 10.

Figure 12:
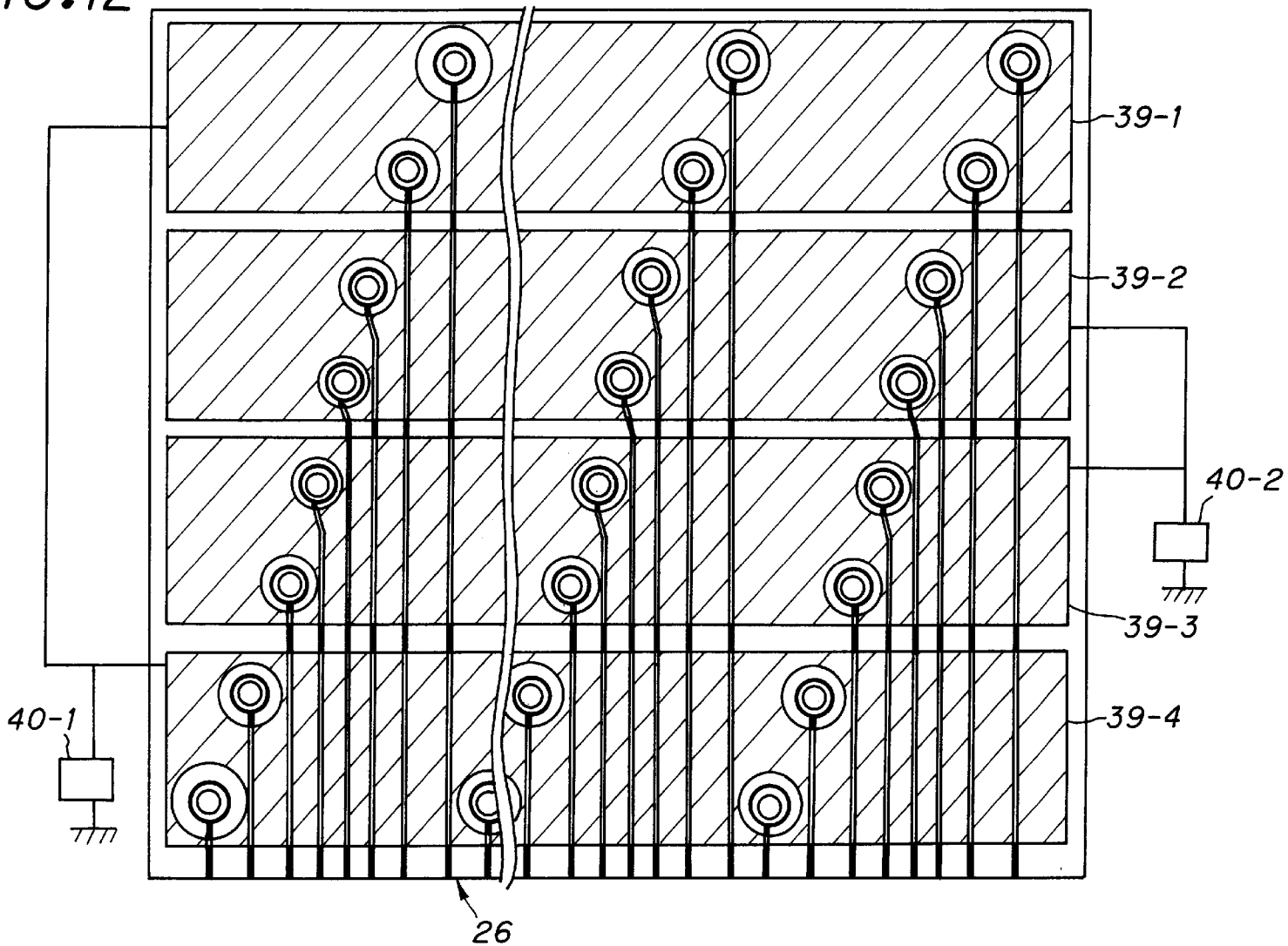
FIG. 12 is a view for illustrating another configuration of a control electrode.

In some usage environments, it is difficult for control electrode 26 of types shown in FIGS. 9 to 11 to make the passing amounts of toner 21 through all gates 29 completely uniform. This case can be dealt with, as shown in FIG. 12, by applying an appropriate voltage to the ends of shield electrode elements 39-1 and 39-4 from shield voltage power source 40-1 and another appropriate voltage to the ends of shield electrode elements 39-2 and 39-3 from shield voltage power source 40-2. Further, it is possible to achieve a further fine and exact control of the jumping of toner 21 by differentiating the size of the openings of shield electrode elements 39.

Figure 13:
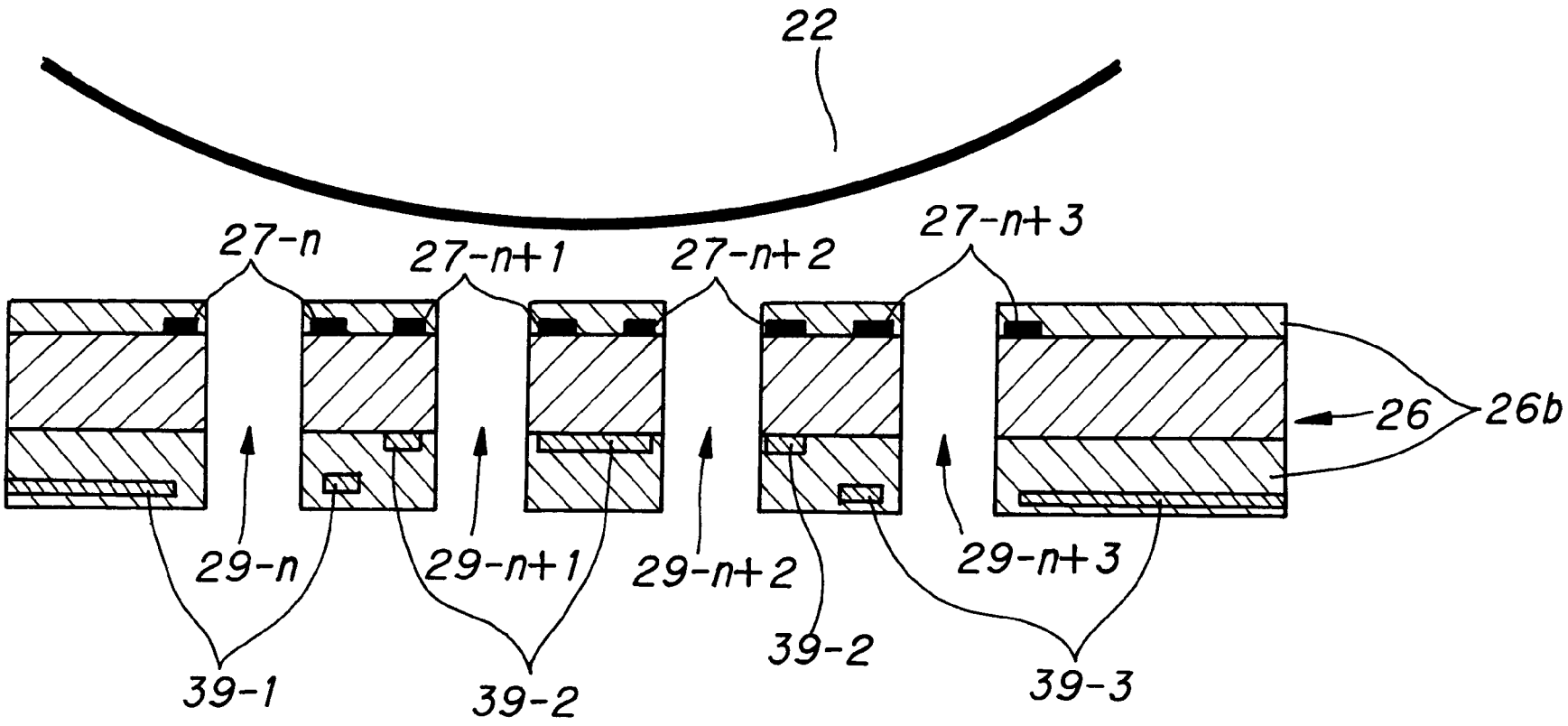
FIG. 13 is a sectional view for illustrating another configuration of a control electrode.

In the above embodiment, the degree of electrical exposure of annular electrode 27 is controlled based on the ratio of the opening diameter of annular electrode 27 to that of shield electrode 39 and the applied voltage to shield electrode 39. Instead of these factors or in addition to these, it is possible to adjust the geometrical position of shield electrode 39 in accordance with the positions of annular electrode 27 and toner support 22. FIG. 13 shows this mode of embodiment. In this embodiment, for centered annular electrodes 27-n+1 and 27-n+2 which are located close to toner support 22, a shield electrode element 39-2 is provided close to these annular electrodes while, for off-centered annular electrodes 27-n and 27-n+3, shield electrode elements 39-1 and 39-3 are provided distant from corresponding annular electrodes. As a result, it is possible to control the degree of exposure of each annular electrode 27 to toner support 22, thus making it possible to produce uniform transfer of toner 21 for all the annular electrodes 27.

Figure 14:
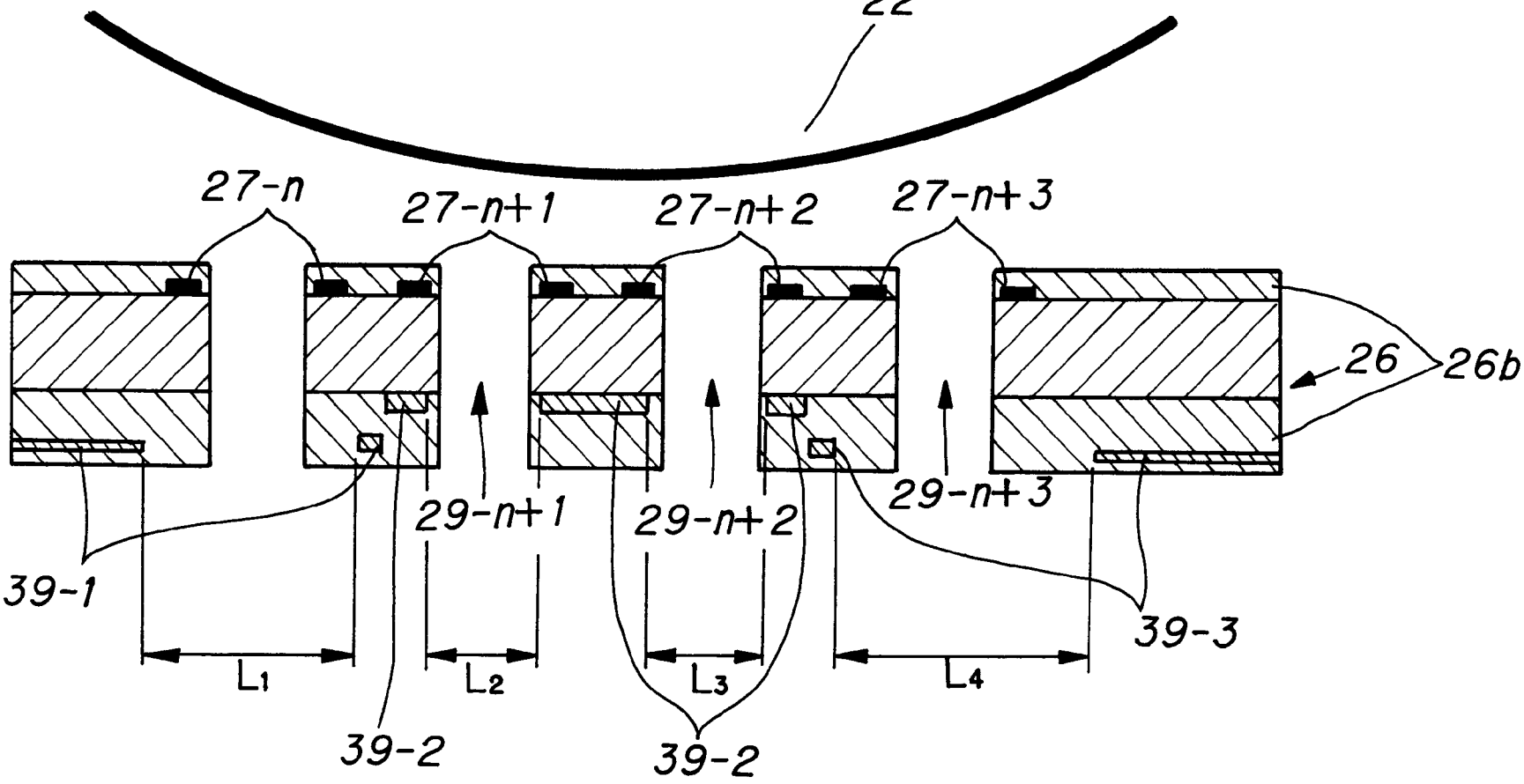
FIG. 14 is a sectional view for illustrating another configuration of a control electrode.
Figure 15:
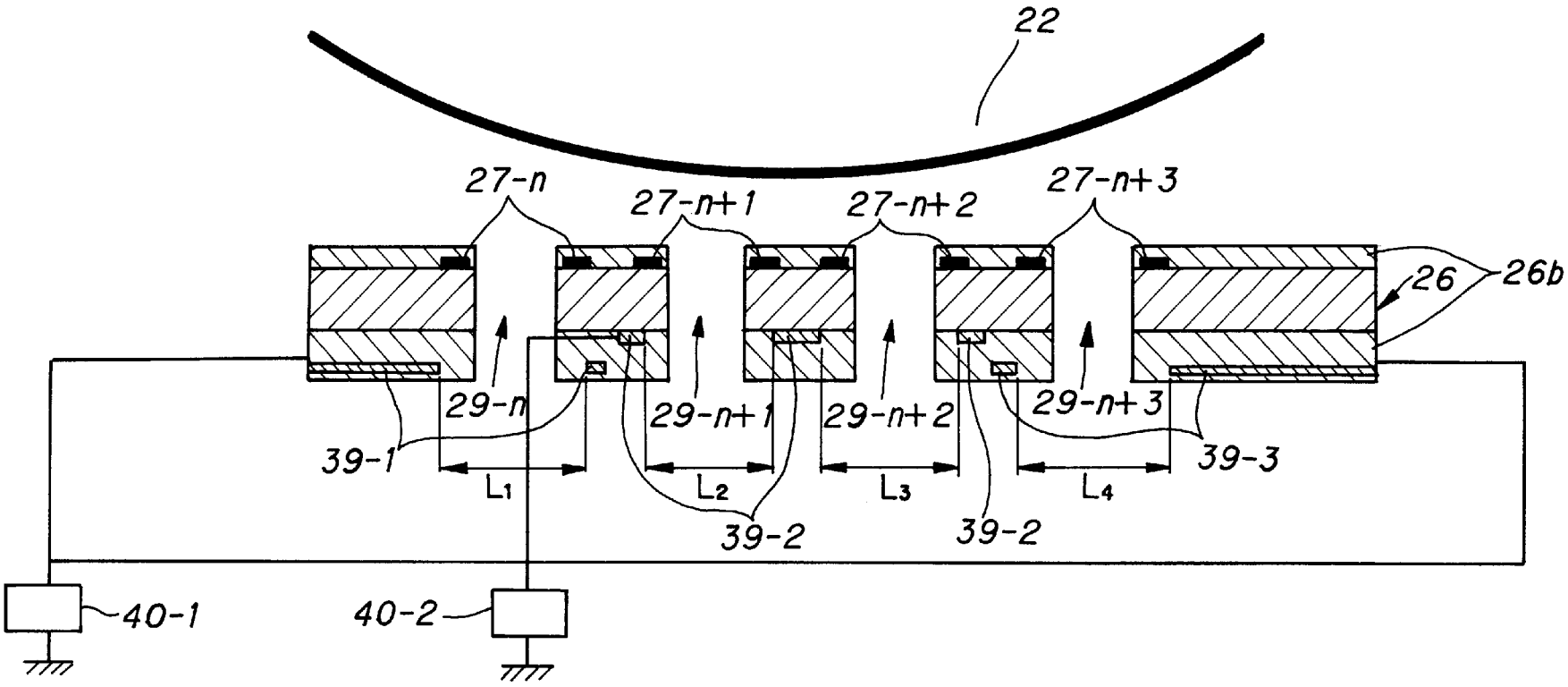
FIG. 15 is a sectional view for illustrating another configuration of a control electrode.
Figure 16:
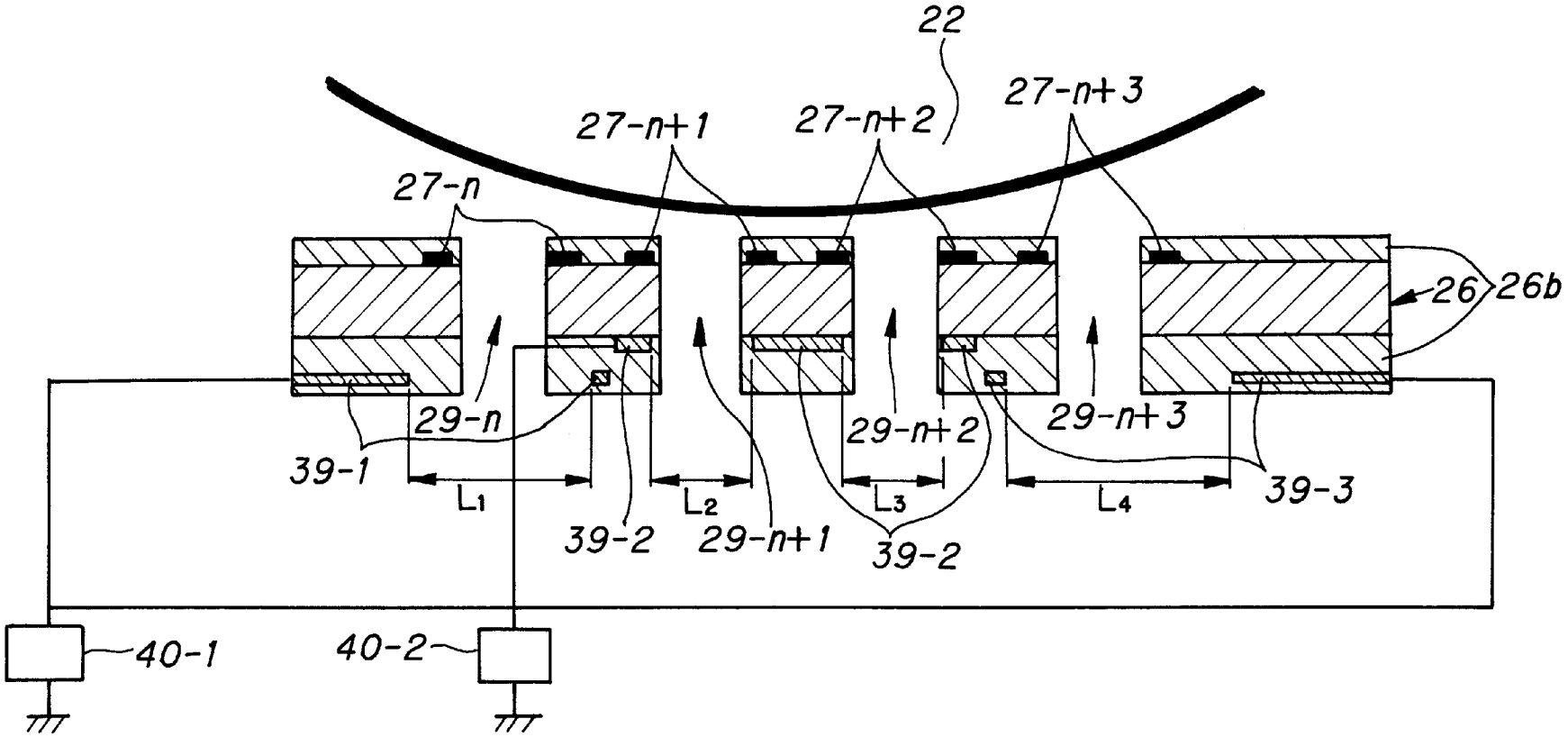
FIG. 16 is a sectional view for illustrating another configuration of a control electrode.

When a finer and more uniform transfer of toner 21 than that in the embodiment of FIG. 13 is needed, configurations shown in FIGS. 14 through 16 are effective in which the opening diameters of shield electrode 39 are varied or the applied voltage is adjusted.

In the embodiment shown in FIG. 14, for the opening diameter of shield electrode 39, the opening diameters $L_1$ and $L_4$ corresponding to gates 29-n and 29-n+3 at the outer sides are set large, whereas the opening diameters $L_2$ and $L_3$ corresponding to gates 29-n+1 and 29-n+2 at the central portion are set small.

However, there are cases where a small margin of the difference in opening diameter between that of shield electrode 39 and that of annular electrode 27 may cause problem for the alignment with one another. In such a case, the opening diameters $L_1$ through $L_4$ of shield electrode 39 may be set constant while shield electrode elements 39-1 and 39-3 located at the outer sides may be applied from a shield voltage power source 40-1 (e.g. −20 V) and shield electrode element 39-2 at the center may be applied from a shield voltage power source 40-2 (e.g. −70 V). This configuration gives a large margin of the difference in opening diameter between that of shield electrode 39 and that of annular electrode 27, allowing easy alignment.

If a further fine and uniform transfer of toner 21 is needed, a configuration shown in FIG. 16 may be naturally considered. That is, in this embodiment, the opening diameters $L_1$ through $L_4$ of shield electrode 39 are manipulated and at the same time shield electrode elements 39-1 and 39-3 which are located at the outer sides are supplied from a shield voltage power source 40-1 and shield electrode element 392 which is located at the center is supplied from a separate shield voltage power source 40-2.

Figure 17:
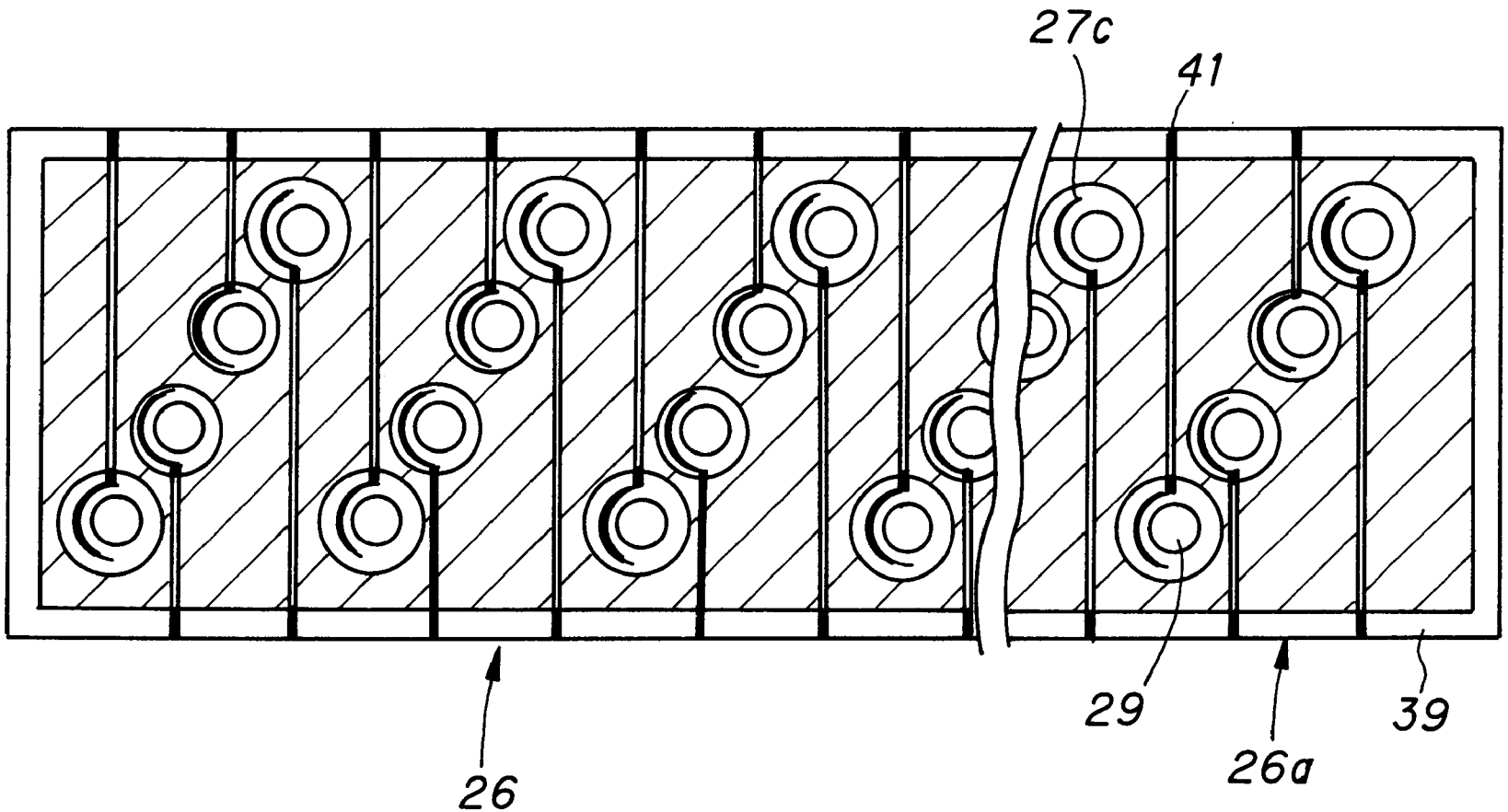
FIG. 17 is a view for illustrating another configuration of a control electrode.

In place of annular electrodes 27 in the above embodiments, it is also possible to use semi-circular electrodes 27*c* as shown in FIG. 17. Further, in addition to use of semi-circular electrodes 27*c*, it is also possible to vary the diameter of the openings of shield electrode 39 in accordance with their distance from toner support 22. Further, it is also possible to vary the size of semi-circular electrodes 27*c*.

In the case where the image forming apparatus is used in a high temperature and high humidity environment, the characteristic values relating to a certain kind of toner 21, such as the amount of static charge thereon and the cohesion thereof, may vary, causing change in jumping behavior of toner 21. In this case, for example, it is preferred that, a probe (not shown) for metering the surface potential of the layer of toner 21 or the like be placed upstream of the area facing the gates 29 so as to measure the amount of static charge and the voltage of shield electrode 39 is adjusted based on the measurement in such a way as to obtain well-ordered jumping of toner 21. Instead of the adjustment of the voltage of shield electrode 39, it is of course possible to control other factors.

Figure 18:
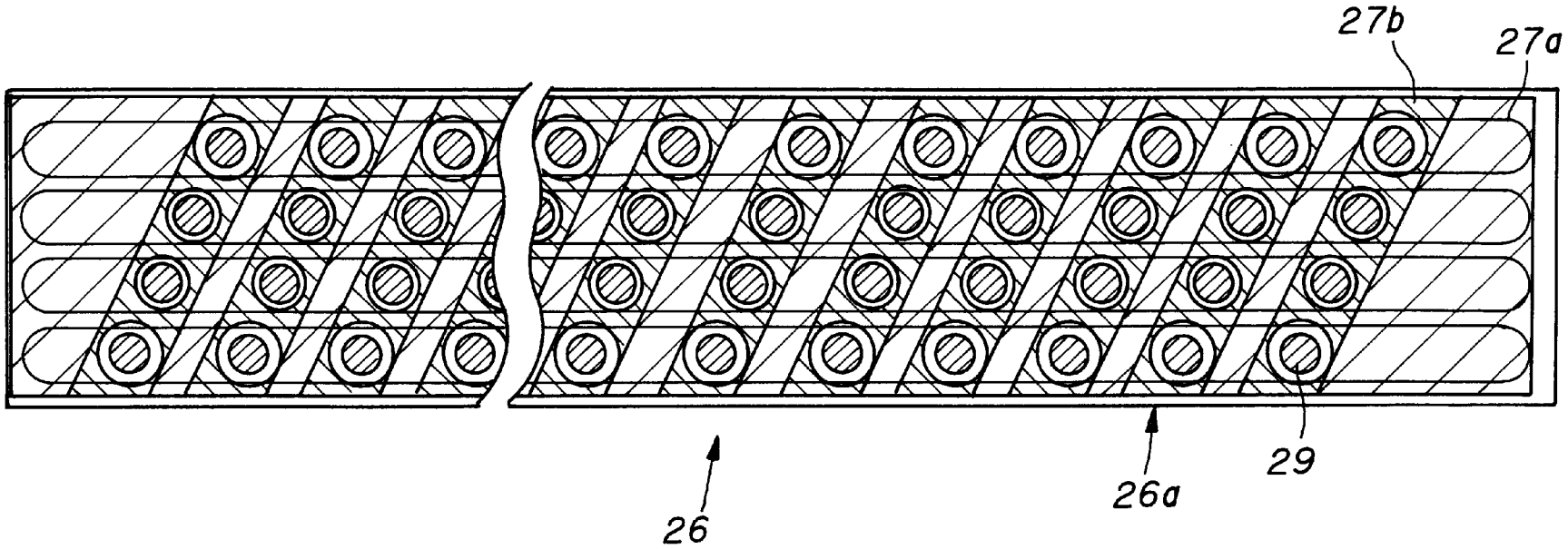
FIG. 18 is an illustrative view of a control electrode of a matrix drive type provided with a shield electrode.

In the above embodiment, description has been made of a configuration of control electrode 26 in which each gate 29 is controlled individually, but it is also possible to achieve a correct image forming operation by using a control electrode 26, shown in FIG. 18, using matrix control. In this configuration, in place of annular electrodes 27, multiple number of electrode strips 27*a* and electrode strips 27*b* are arranged crossing over each other at an angle so that selection of a gate 29 is made by the combination of electrode strips 27*a* and 27*b*. This method can markedly reduce the number of driver FETs as the means for driving gates 29.

FIG. 18 shows a control electrode in which the diameters of the openings of shield electrode 39 are made different depending on its distance from toner support 22. In addition to this configuration, it is also possible to control the jumping of toner 21 by adjusting the size of the openings of shield electrode 39, the size of the openings in electrode strips 27*a* and 27*b*, and the voltage of shield electrode 39.

Figure 19:
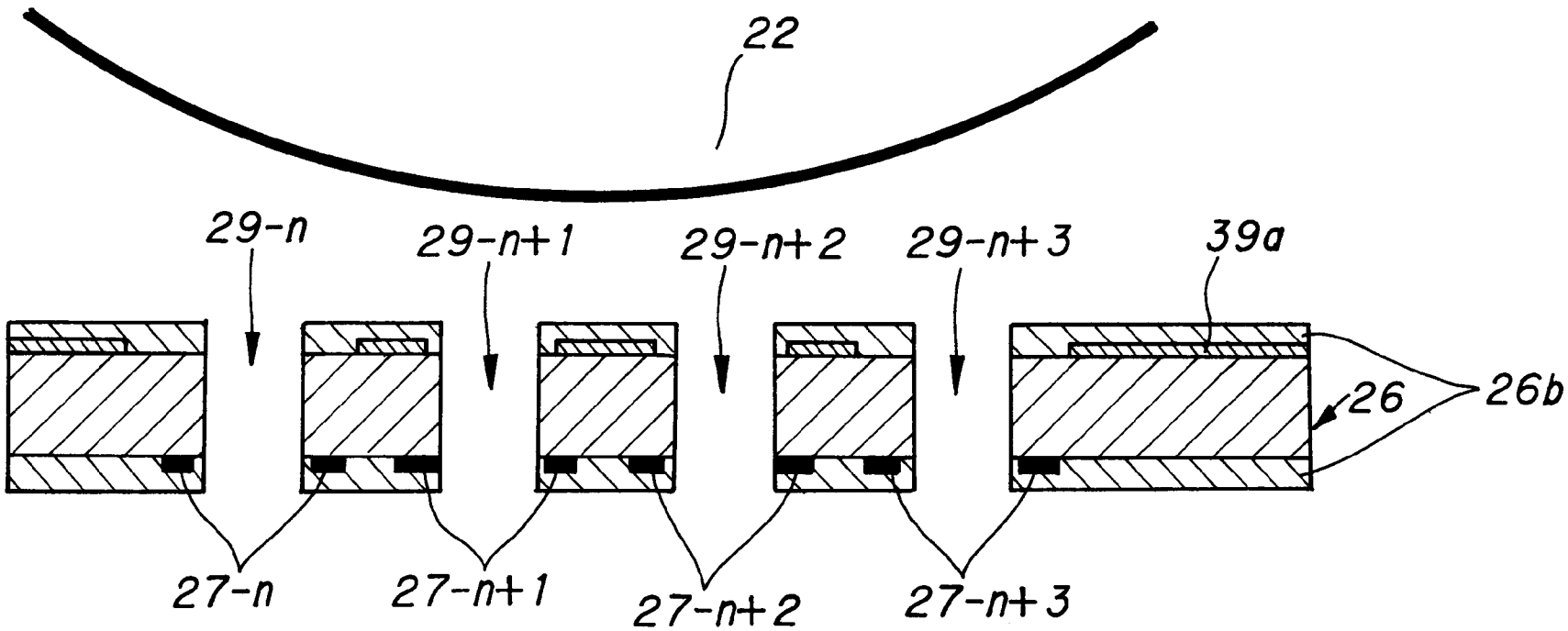
FIG. 19 is a sectional view for illustrating another configuration of a control electrode.

Further, in contrast to the above embodiment, it is possible to configure an arrangement in which a shield electrode 39*a* is provided between toner support 22 and annular electrodes 27 as shown in the embodiment of FIG. 19, so as to control the jumping of toner 21 in a similar manner. This configuration provides a wider variation within which the degree of electrical exposure for causing toner 21 to jump can be controlled, than the case where the degree of electrical exposure of annular electrodes 27 is controlled by adjusting the ratio of the opening diameter of annular electrode 27 and that of shield electrode 39 which is provided on the opposing electrode 25 side. In other words, even a configuration in which the ratio between the opening sizes is set to be small can still provide a significant effect.

For example, the diameter of the openings in shield electrode 39 for gates 29-n+1 and 29-n+2 in FIG. 5 is 220 μm and the diameter of the openings in shield electrode 39 for gates 29-n and 29-n+3 is 300 μm. This means that this configuration needs a difference in opening diameter of 80 μm in order to correct the difference in the jumping amount of toner 21 between off-centered gates 29-n and 29-n+3 and centered gates 29-n+1 and 29-n+2.

In contrast, in the configuration shown in FIG. 19, it is possible to achieve the correction with even a smaller opening diameter difference so that the openings in shield electrode 39 for off-centered gates 29-n and 29-n+3 are 280 μm in diameter and those for centered gates 29-n+1 and 29-n+2 are 220 μm in diameter.

Further, a voltage applied to shield electrode 39*a* has a large effect so that the voltage can be set at a low level, resultantly making it possible to use a low voltage configuration and reduce the cost of the power source.

For the configuration shown in FIG. 19 in which shield electrode 39*a* is provided between toner support 22 and annular electrodes 27, it is of course possible to apply the aforementioned various modes of embodiments to the configuration in which shield electrode 39*a* is provided on the opposite side with respect to annular electrodes 27, and hence the description will not be repeated.

Figure 20:
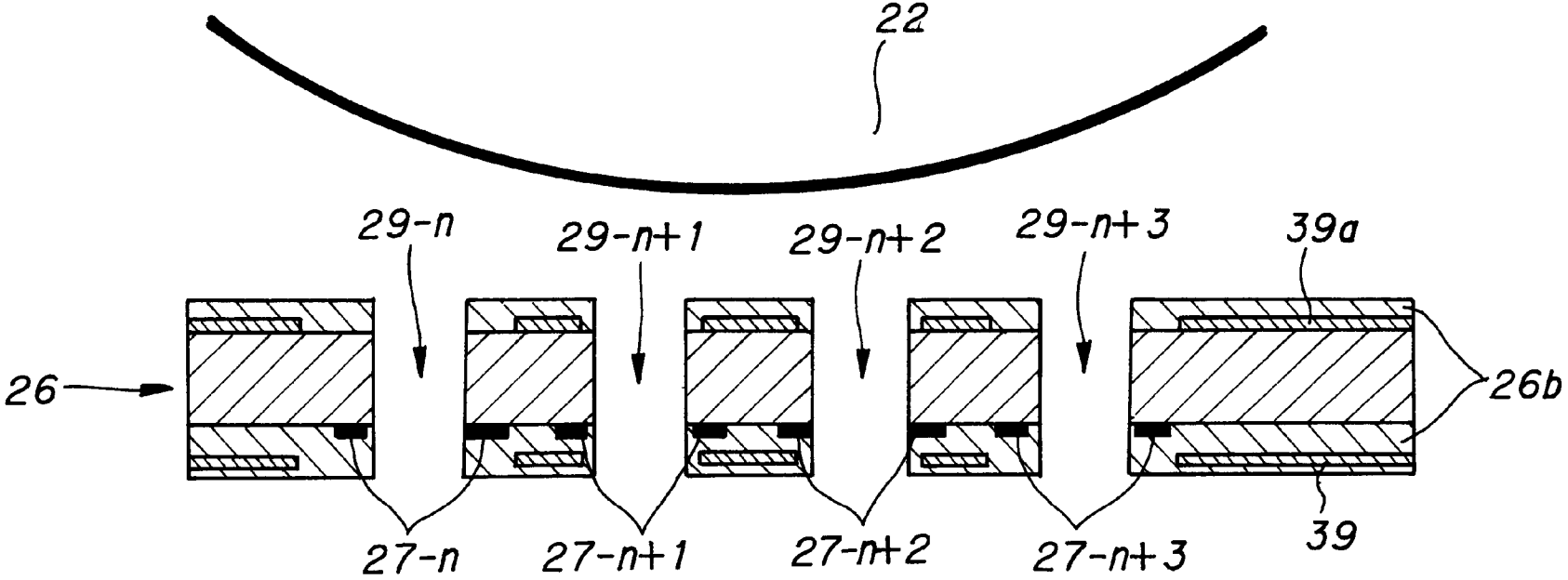
FIG. 20 is a sectional view for illustrating another configuration of a control electrode.

It is also possible to provide a shield electrode 39 on the side close to opposing electrode 25 and a shield electrode 39*a* on the side close to toner support 22, as shown in FIG. 20. In this case, it is possible to provide a configuration in which shield electrode 39 has openings of a uniform diameter and shield electrode 39*a* is formed so as to be controlled in a similar manner as in the above embodiment. Alternatively, it is also possible to provide a configuration in which shield electrode 39*a* has openings of a uniform diameter and shield electrode 39 is formed so as to be controlled in a similar manner as in the above embodiment. Moreover, it is also possible to provide a configuration in which both the shield electrodes 39 and 39*a* are formed so as to be controlled in a similar manner as in the above embodiment.

Figure 21:
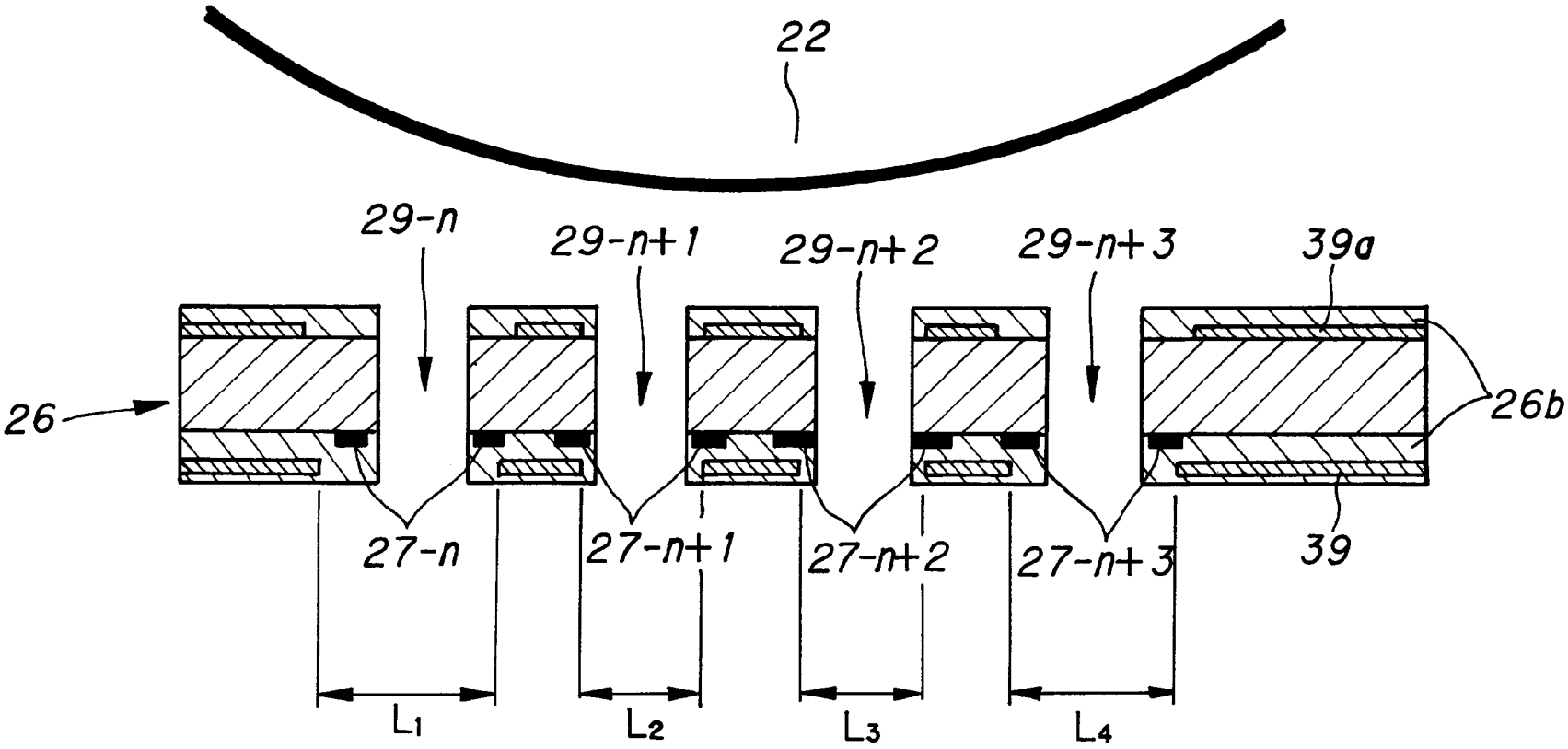
FIG. 21 is a sectional view for illustrating another configuration of a control electrode.

FIG. 21 shows an embodiment in which both shield electrodes 39 and 39*a* are formed so that the sizes of their openings are controlled. With regard to both shield electrodes, the ratio of the diameter of the opening to that of each gate 29 may be set constant or different. In FIG. 21, the openings in shield electrode 39*a* for off-centered gates 29-n and 29-n+3 are configured greater in their diameter than those in shield electrode 39.

Figure 22:
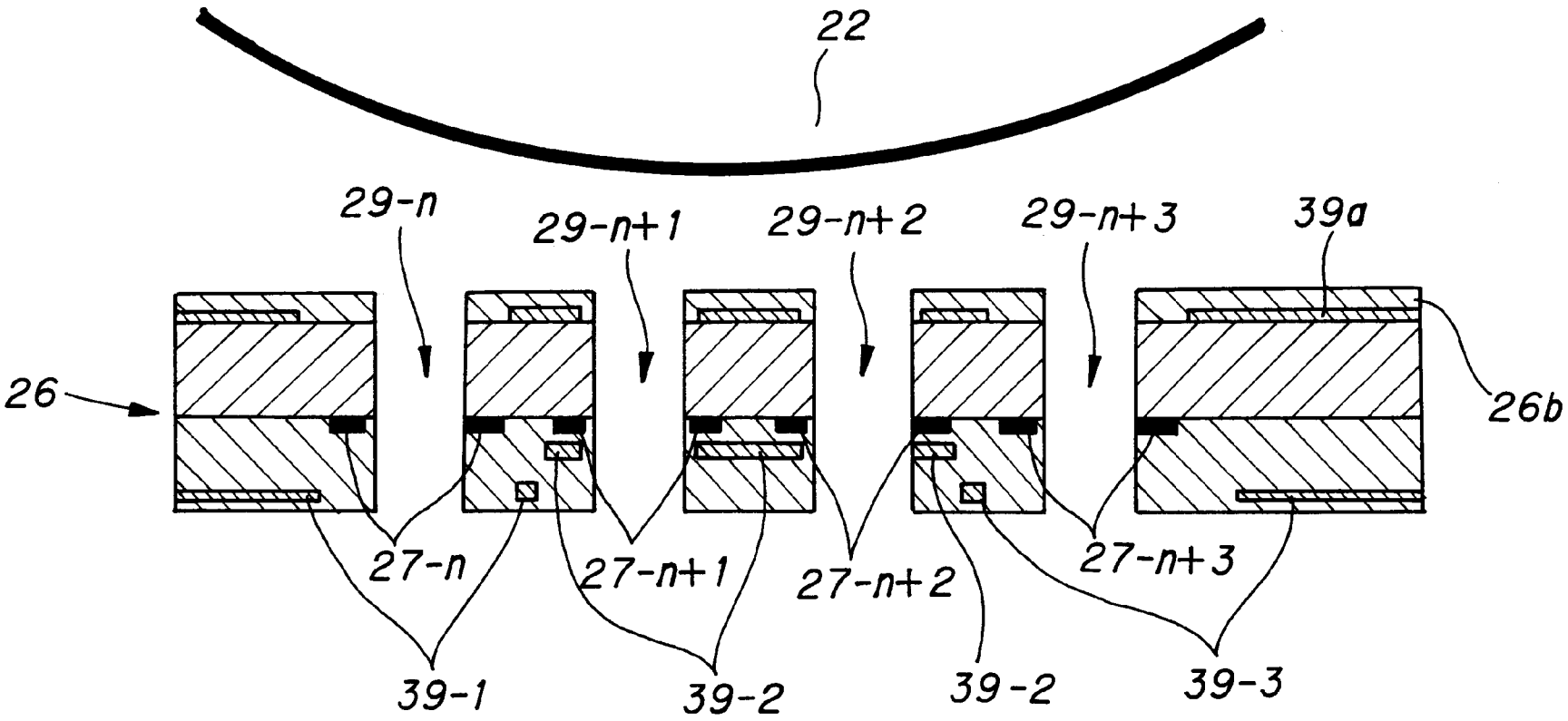
FIG. 22 is a sectional view for illustrating another configuration of a control electrode.
Figure 23:
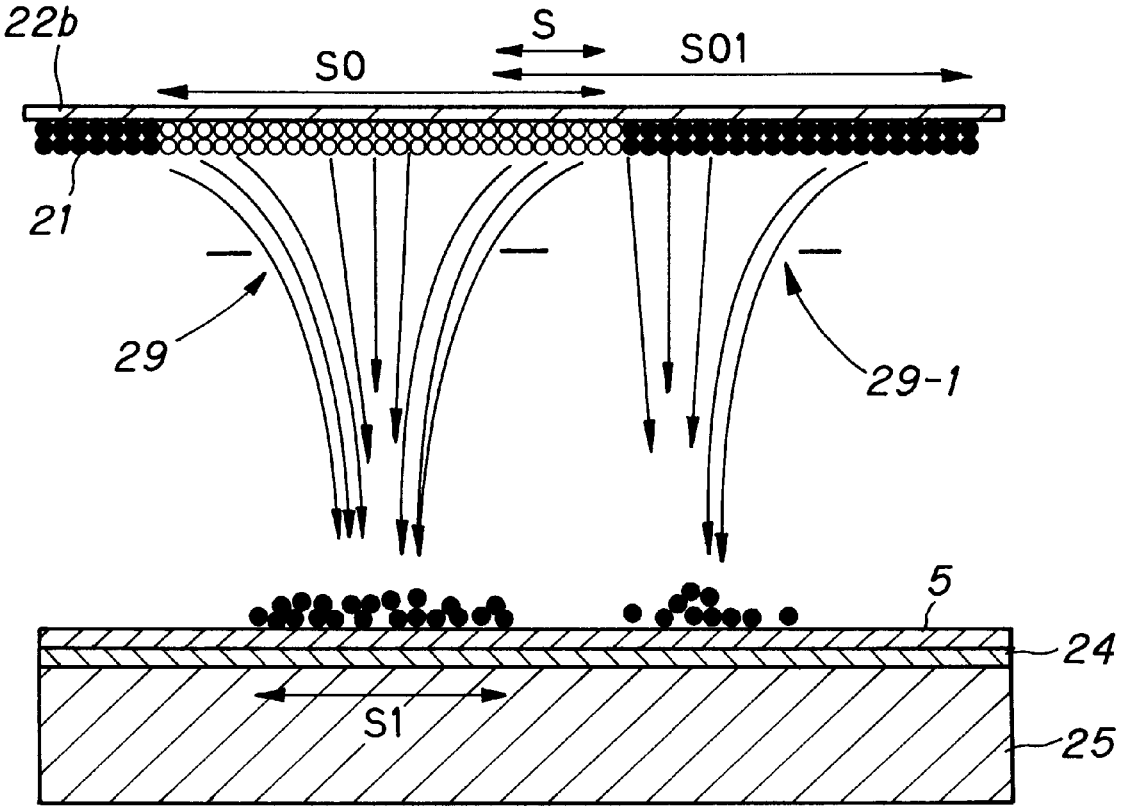
FIG. 23 is a sectional view for explaining the jumping state of the toner.

FIG. 22 shows an embodiment in which shield electrode 39 is divided into plural elements, the element for centered gates 29-n+1 and 29-n+2 being disposed closer to toner support 22, the elements for off-centered gates 29-n and 29-n+3 being disposed more distant therefrom. In contrast, it is also possible to provide a configuration in which the elements of shield electrode 39 for the off-centered gates are disposed closer while the element for the centered gates is disposed more distant.

Control of shield electrodes 39 and 39*a* is not limited to the combinations described above, but can be configured with an appropriate configuration depending upon the features of the apparatus.

A configuration in which shield electrodes are provided on both sides of control electrode 26 as described above, produces various advantages which improve the quality of image. For example, by controlling the diameters of the openings in shield electrode 39*a* in a different manner as shown in FIG. 20 and 21, it is possible to produce uniform jumping of toner 21 under the combined effect from shield electrodes 39 and 39*a*. This case neither needs any extra power source nor any division of shield electrodes 39 and 39*a* into pieces.

Provision of shield electrode 39 is effective in converging the flow of toner 21 as it passes through gate 29. However, when the diameters of the openings in shield electrode 39 are made markedly different, it becomes difficult, in some cases, to produce high enough convergence effect. In such a case, the variation of the diameter of the openings in shield electrode 39 should be minimized and the position and diameter of the openings in shield electrode 39 and the potential thereof may be controlled so as to provide the desired jumping of toner 21.

Further, provision of shield electrode 39 affects the area on toner layer 21 formed on toner support 22, from which toner 21 jumps. This situation will be explained with reference to FIG. 23. First, when toner 21 is made to jump through a gate 29, toner 21 jumps from an area S0 on toner support 22. Subsequently, when toner 21 is caused to jump through gate 29-1 which is adjacent to gate 29, toner 21 would be caused to jump from area S01 which is equi-sized to area S0 that faces gate 29. However, no toner 21 resides in area S due to the toner transfer caused by gate 29. Since an insufficient amount of toner 21 passes through gate 29-1, the dot formed on paper 5 will be small and lacking in density. Accordingly, a blurred image without contrast will be produced.

Shield electrode 39 is effective in dealing with this type of problem and can make the area from which toner 21 jumps, small enough so as not to affect the jumping of the toner through adjacent gate 29. It is also possible to control the degree of electrical exposure of annular electrode 27 in the manner described above, in combination with shield electrode 39, to thereby cause all arbitrary gates 29 to produce a uniform area from which the toner jumps.

Control of the area from which toner 21 jumps is performed more effectively by shield electrode 39*a* which is closer to toner 21. Nevertheless, even when the areas from which toner 21 jumps are controlled through off-centered and centered gates 29, there are cases where dots forming on paper 5 become different because of the difference of the trajectory of toner 21 that jumps. In such a case, it is preferred that shield electrode 39 is controlled so as to make the jumping toner 21 converge appropriately to thereby produce a uniform dot.

Figure 24:
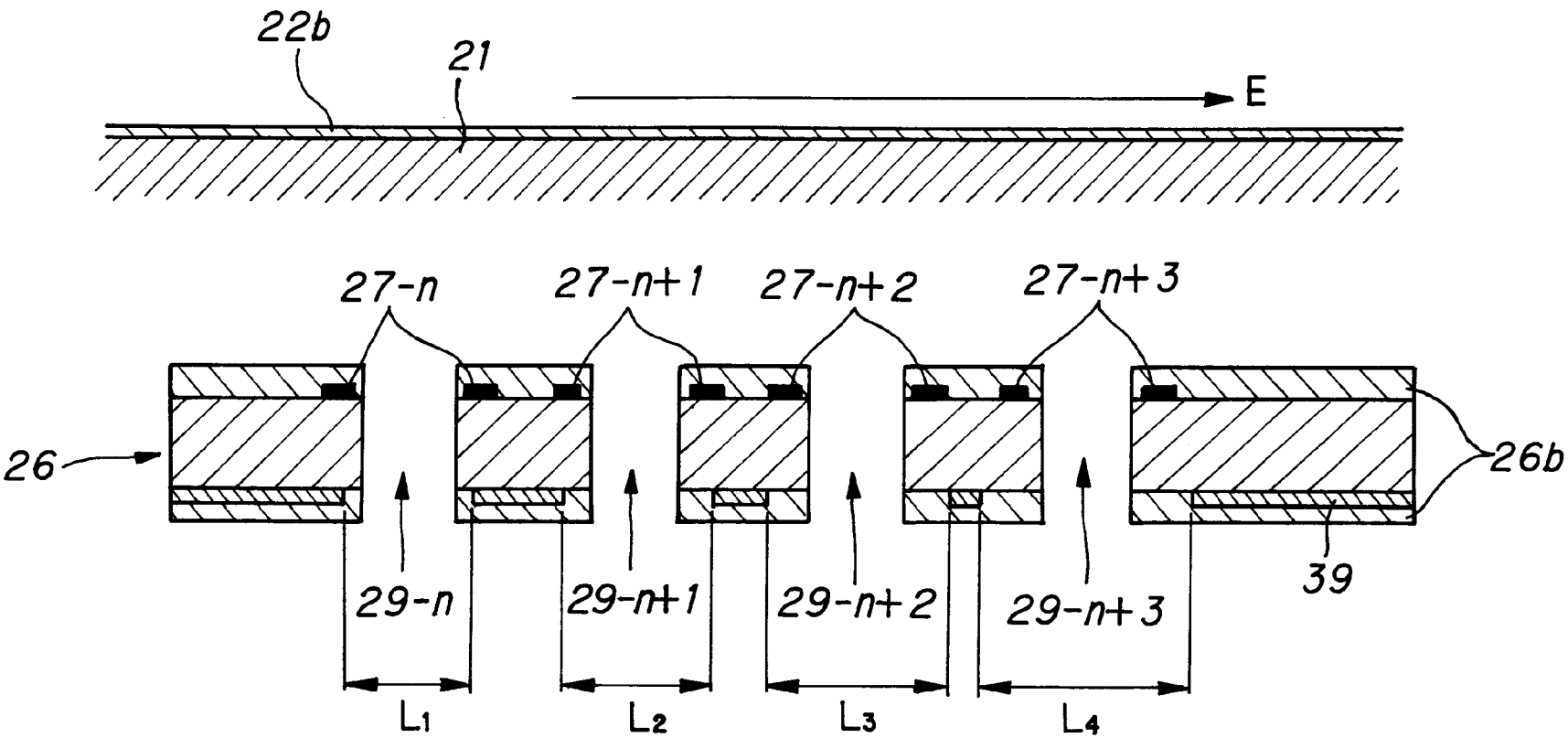
FIG. 24 is a sectional view for explaining another arrangement of a toner support and a control electrode.

Unevenness of jumping of toner 21 will occur not only due to the variation of the distance between toner support 22 and control electrode 26 as stated above, but it also occurs when a belt type toner support 22*b* is used which has a flat surface as shown in FIG. 24. Illustratively, there are cases where, when two neighboring gates 29 are activated to cause toner 21 to jump, the jumping of toner 21 through the subsequent printing gate 29 will be affected by the jumping of toner 21 through the precedent printing gate 29.

Figure 25A:
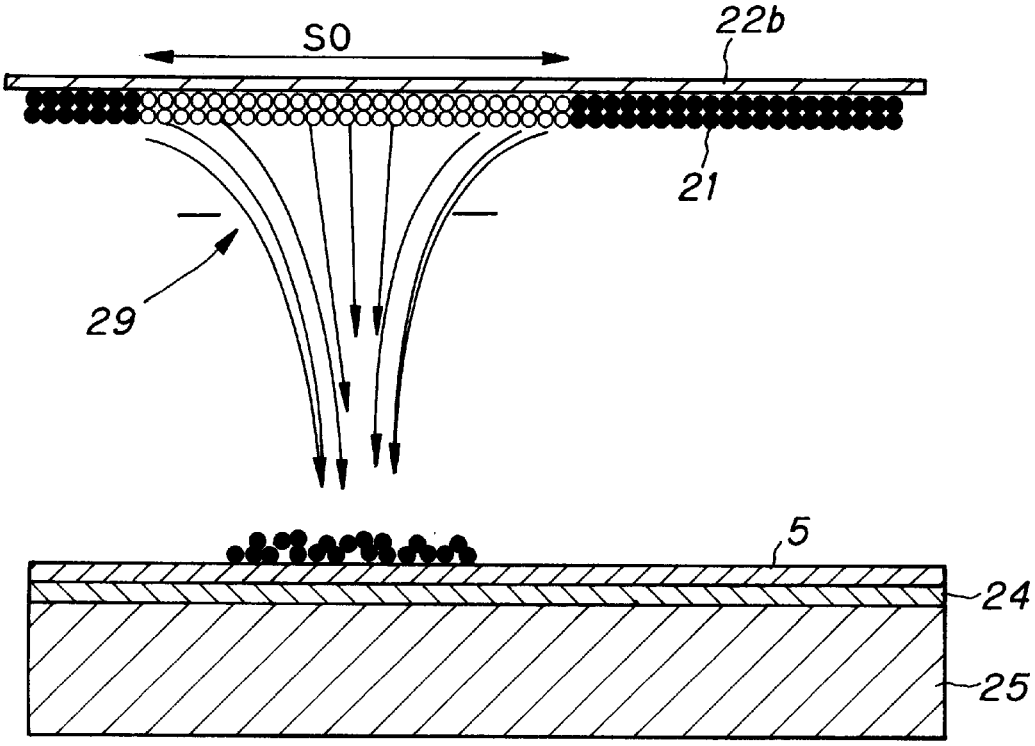
FIGS. 25A and 25B are sectional views for explaining the jumping state of the toner.
Figure 25B:
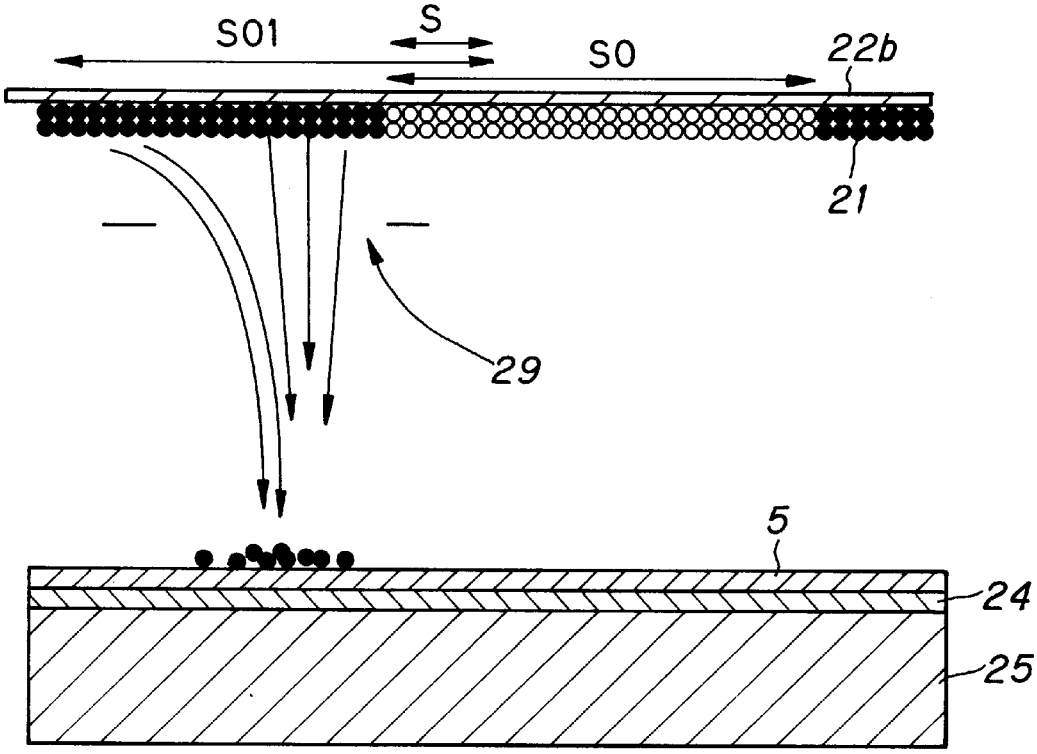

This phenomenon will be explained referring to FIG. 25. As shown in FIG. 25A, when toner 21 is caused to jump through an arbitrary gate 29, toner 21 supported on toner support 22*b* jumps from an area S0 to reach paper 5, forming a dot. Subsequently, as shown in FIG. 25B, when toner 21 is caused to jump through the adjacent gate 29, toner 21 would be caused to jump from area S01 which is equi-sized to the area of the previous toner transfer. However, no toner 21 resides in area S due to the toner transfer caused by gate 29. Since an insufficient amount of toner 21 transfers through gate 29, the dot formed on paper 5 will be small and lacking in density. Accordingly, a blurred image without contrast will be produced.

This phenomenon occurs on the downstream side with respect to the direction of movement of toner support 22*b* when the speed of movement of toner support 22*b* is so low that the support will not move far enough relative to the printing interval. Also in this case, it is preferred to control shield electrodes 39 and 39*a* so as to provide uniform jumping of toner 21. In FIG. 24, toner support 22*b* is moving in the direction of arrow E, and therefore, the openings in shield electrode 39 are set greater in diameter in the order of $L_1 \rightarrow L_2 \rightarrow L_3 \rightarrow L_4$ or greater as they are positioned more downstream. For example, opening $L_1$ located on the most upstream side is set at 220 $\mu$m in diameter, the second opening $L_2$ at 280 $\mu$m, the third opening $L_3$ at 300 $\mu$m and the fourth opening $L_4$ at 320 $\mu$m. The setting of the size of these openings may and should be determined as appropriate based on the type of toner 21, the speed of movement of toner support 22*b* and the features of the apparatus.

Further, it is also possible to perform control in combination with the example shown in FIG. 24 with any of the examples shown in FIGS. 5 through 16. For instance, there is a method of dividing shield electrode 39 into multiple elements, each of which is applied with a different voltage. In this case, an exemplary method is that, for example, the shield electrode element 39 located on the most upstream side is adapted to be applied with a voltage which maximally inhibits toner 21 to jump and the voltage which inhibits toner 21 to jump is weakened toward the downstream side.

Figure 26:
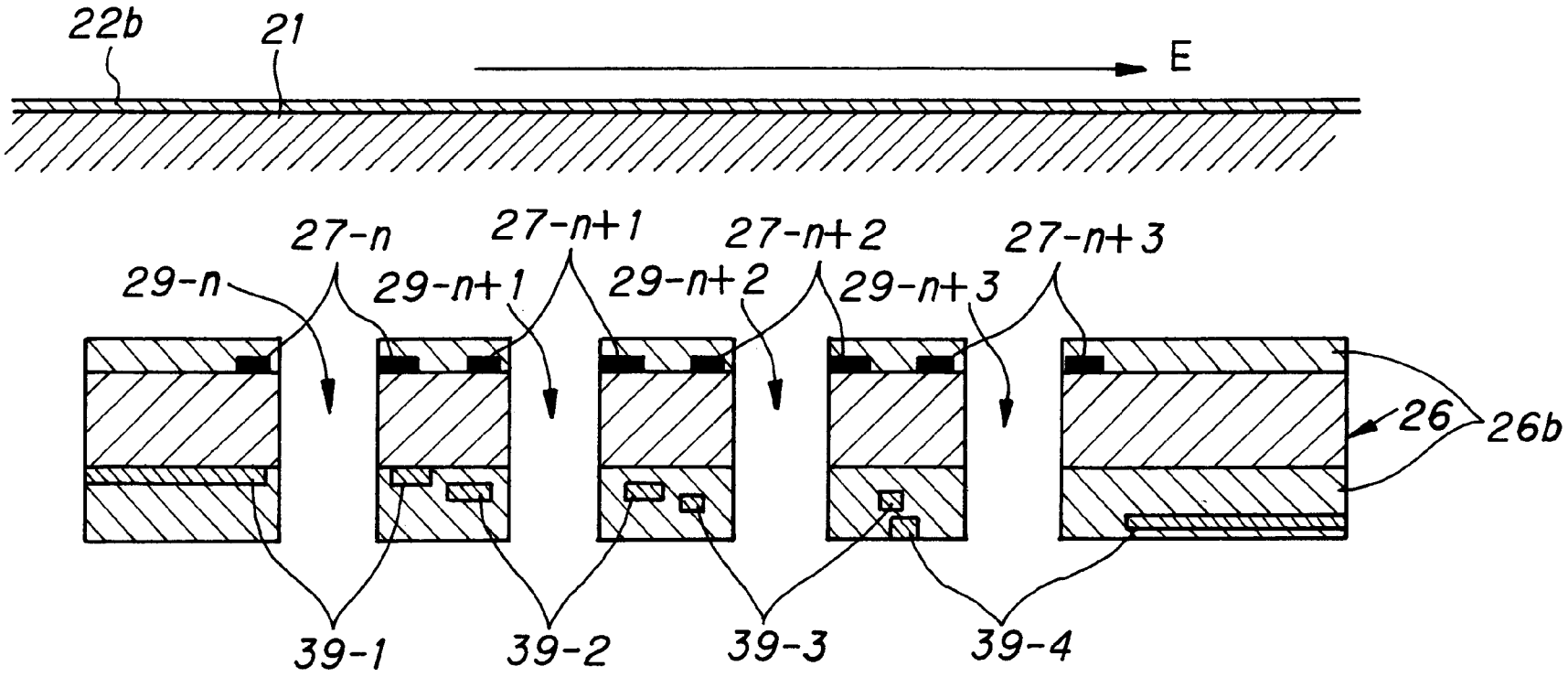
FIG. 26 is a sectional view for illustrating another configuration of a control electrode.

It is also possible to divide shield electrode 39 into multiple elements as shown in FIG. 26 and position shield electrode elements 39-1 to 39-4 (from upstream to downstream) so that the elements are arranged more distant from toner support 22 as they approach the downstream side.

Further, it is also possible to control the diameter of the openings in addition to the control of the positions of shield electrode elements 39-1 to 39-4. Further, the voltage applied to shield electrode elements 39-1 to 39-4 may be controlled additionally. Moreover, it is also possible to provide an extra shield electrode 39*a* on the side close to the toner support 22*b* and control the toner under the combined effect from these electrodes.

The phenomenon shown in FIG. 25 could occur with respect to a toner support 22 having curvature. Therefore, it is effective to provide a shield electrode having a similar configuration to that of flat type toner support 22*b*.

Further, in place of annular electrode 27, it is possible to use various types of electrodes shown in FIGS. 17 and 18.

It is also possible to control the jumping of toner 21 by adjusting the ratio of the opening diameter of annular electrode 27 to that of the opening in shield electrode 39.

Moreover, the shape of the opening of each electrode is not limited to a circle but the opening may be shaped in the form of an ellipse or rectangle.

Figure 27:
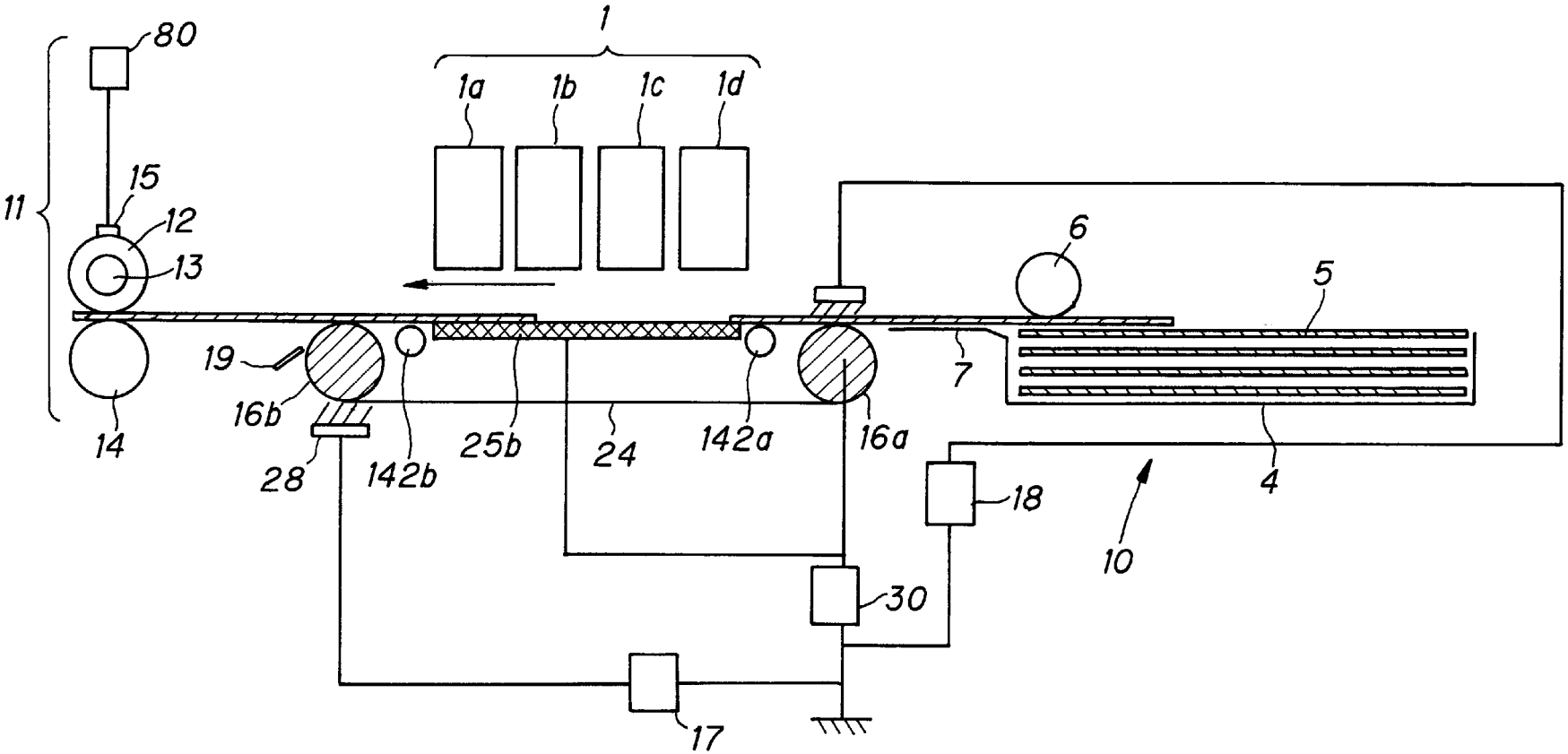
FIG. 27 is a view showing the configuration of a color image forming apparatus based on an image forming apparatus of the invention.

The image forming apparatus of the present invention can also be applied to a color image forming apparatus with a significant effectiveness. As shown in FIG. 27, each of image forming units 1*a*–1*d* for supplying color toners, includes a toner supplying portion for supplying a color toner, i.e., yellow, magenta, cyan or black, and a corresponding printing portion. Each step of image forming with a different color of toner is performed in the sequence of the image forming described already. In accordance with the image forming apparatus of the invention, it is possible to produce color images of a high quality as well.

In the description of the embodiment, the example where toner is used as the developer was explained, but ink etc. can be used as the developer. It is also possible to construct the toner supplying section with a structure using an ion flow process.

In accordance with the first configuration, since the degrees of exposure (including the degree of electrical exposure) of the gate electrodes to the toner support or the toner carried on the toner support are adjusted by the shield electrode, the jumping amount of toner can be easily made to jump uniformly, thus making it possible to achieve excellent image forming. Further, since no voltage for determining whether the toner should be caused to jump is used in order to stabilize the jumping of the toner, there is no need to provide a voltage switching means or the like.

In accordance with the second configuration, the degree of exposure is adjusted based on the position of shield electrode relative to the toner support and relative to the electrode group. Therefore, when the distance between the toner support and the control electrode is not uniform across the whole surface of the control electrode, it is possible to control the jumping of toner correctly in accordance with the varying distance.

Further, since the degree of exposure is controlled based on the potential difference of the shield electrode from the toner support and from the electrode group, it is possible to achieve a further fine and exact control of the behavior of the toner.

Since the degree of exposure is controlled based on the ratio of the exposed portion of the shield electrode to that of the electrode group, the control electrode can be configured in a more simple manner.

Since the position, voltage, dimension, etc. relating to the shield electrode are controlled in combination when the degree of exposure is controlled based on the shield electrode, it is possible to achieve fine and exact control.

In accordance with the third configuration, it is possible to adjust the degree of exposure of each electrode group in accordance with the characteristics of each gate.

In accordance with the fourth configuration, in the case where the jumping state of the toner is liable to change depending upon the service environment of the image forming apparatus, it is possible to adjust the voltage and position of the shield electrode in accordance with the status change.

In accordance with the fifth configuration, the following effect can be attained. That is, when the distance between the toner support and the control electrode is not uniform and hence the electric field generated at one site at the toner support surface by the voltage applied to the control electrode for controlling the jumping of toner is different from another site depending upon the distance to the control electrode, the degree of exposure of the electrode group (including the degree of electrical exposure) to the toner support or the toner carried on the toner support is adjusted by the shield electrode. Hence it is possible to perform control such that the toner will be transferred uniformly or in a desired amount through any gate.

In accordance with the sixth configuration, it is possible to control the degree of exposure of the electrode group based on the ratio between the opening diameter of the electrode group and that of the shield electrode.

In accordance with the seventh configuration, since multiple shield electrode elements are used to control the degree of electrical exposure of the control electrode, it is possible to achieve a more efficient and finer control. Further, in some embodiments, use of the multiple shield electrodes may make unnecessary the control of the voltage to be applied to sectioned shield electrode elements, thus making it possible to reduce the components of the power source. Further, since the area from which the toner can jump is controlled so as to produce uniform dots, it is possible to produce good images.

In accordance with the eighth through fourteenth configurations, it is possible to adjust the aforementioned degree of exposure in such a manner that the ratio of the diameter of the openings in an electrode group to that of the openings in shield electrode will be decreased as the distance from the toner support to the electrode group increases.

Since the aforementioned degree of exposure is controlled by varying the diameter of the openings in the shield electrode, the layout of the electrode groups are not affected, resultantly it is possible to avoid reduction of the production yield due to high-density provision of electrode groups.

The degree of exposure is controlled based on the applied voltage to the divided shield electrode elements so that the toner will be transferred uniformly through any gate. Accordingly, there is no need to use either a high withstanding voltage FET or means for switching the voltage to be applied to the shield electrode.

Since the degree of exposure is controlled by simple control of the diameter of the openings in the shield electrode, the layout of the electrode groups are not affected, resultantly it is possible to avoid reduction of the production yield due to high-density provision of electrode groups. Further, since the individual shield electrode element has openings of an identical diameter, the mask for the shield electrode can be formed with a simple configuration.

Since the diameter of the openings in each shield electrode element is varied, it is possible to minimize complexity and increase in cost during the production process of the shield electrode. Further, application of a voltage to the shield electrode makes it possible to enhance the control of an arbitrary gate electrode hence producing desired toner jumping with correct fineness.

Since the diameter of each opening within each shield electrode element is made different depending upon the distance between the electrode group and the developer support, it is possible to achieve a more delicate control of the jumping amount of toner.

Since the degree of exposure of the electrode group is controlled by varying the location of the shield electrode depending upon the distance from the toner support, it is possible to make use of the electric field effect of the shield electrode in a more efficient manner.

Since the degree of exposure of the electrode group is controlled by varying the location and opening diameter of the shield electrode depending upon the distance between the electrode group and the developer support, it is possible to make use of the electric field effect of the shield electrode in a more efficient manner.

Since the degree of exposure of the electrode group is controlled by varying the location and applied voltage of the shield electrode depending upon the distance between the electrode group and the developer support, it is possible to make use of the electric field effect of the shield electrode in a more efficient manner.

Since the degree of exposure of the electrode group is controlled by varying the location, opening diameter and applied voltage of the shield electrode depending upon the distance between the electrode group and the developer support, it is possible to make use of the electric field effect of the shield electrode in a more efficient manner.

In accordance with the fifteenth configuration, since the degrees of electrical exposure of the electrode groups are increased toward the downstream side with respect to the direction of movement of the toner support, it is possible to produce uniform toner transfer throughout the control electrode even in a configuration in which fine transfer of toner is hard to obtain on the downstream side.

What is claimed is:

1. An image forming apparatus comprising:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming passages for the developer;

one or more electrode groups provided covering a multiple number of the gates; and a shield electrode having one or more electrode elements each having openings which directly or electrically expose at least part of the gates and the electrode groups with the gates to the developer support;

a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around the gates, to the developer carried on the developer support is controlled by the shield electrode;

a detecting means for detecting characteristics of the developer or characteristic values of the developer being carried on the developer support, comparing the detected characteristic values of the developer with predetermined developer characteristics and outputting the detected values, and wherein, based on the detected values, the control means controls the degree of exposure by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group so as to perform individual control for each gate or identical control for a plurality of gates.

2. The image forming apparatus according to claim 1, wherein the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

3. An image forming apparatus comprising:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming passages for the developer;

one or more electrode groups provided covering a multiple number of the gates; and a shield electrode having one or more electrode elements each having openings which directly or electrically expose at least part of the gates and the electrode groups with the gates to the developer support;

a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around the gates, to the developer carried on the developer support is controlled by the shield electrode; and wherein the degree of exposure which is controlled by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group is controlled so as to vary in accordance with the distance between the gate and the developer or the strength of the electric field generated by the control means, and individual control is performed for each gate or identical control is performed for a plurality of gates while the control of the degree of exposure of a gate or the electrode disposed with the gate at least includes control based on the size of the electrode and the size of the opening formed in the shield electrode.

4. The image forming apparatus according to claim 3, wherein the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

5. An image forming apparatus comprising:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming passages for the developer;

one or more electrode groups provided covering a multiple number of the gates;

a first shield electrode disposed between the electrode groups and the opposing electrode and having one or more electrode elements each having openings which directly or electrically expose at least part of gates and the electrode groups with the gates, to the developer support; and a second shield electrode disposed between the electrode groups and the opposing electrode and having one or more electrode elements each having openings which directly or electrically expose at least part of gates and the electrode groups with the gates, to the developer support; and a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around gates, to the developer carried on the developer support is controlled by the first or the second shield electrode or combined function of the first and second shield electrodes.

6. An image forming apparatus comprising:

a supplying means at least having a developer support carrying one color of developer;

an opposing electrode disposed facing the developer support;

a control electrode at least comprising:

an insulative substrate disposed between the developer support and the opposing electrode:

a plurality of gates formed in the insulative substrate for forming passages for the developer;

one or more electrode groups provided covering a multiple number of the gates; and a shield electrode having one or more electrode elements each having openings which directly or electrically expose at least part of the gates and the electrode groups with the gates to the developer support;

a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around the gates, to the developer carried on the developer support is controlled by the shield electrode; and wherein the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

7. An image forming apparatus comprising:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming passages for the developer;

one or more electrode groups provided covering a multiple number of the gates; and a shield electrode having one or more electrode elements each having openings which directly or electrically expose at least part of the gates and the electrode groups with the gates to the developer support;

a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around the gates, to the developer carried on the developer support is controlled by shield electrode;

wherein the degree of exposure of the arbitrary one of gates or the electrode groups disposed around the gates, to the developer carried on the developer support is controlled by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group; and wherein the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

8. An image forming apparatus comprising:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming passages for the developer;

one or more electrode groups provided covering a multiple number of the gates; and a shield electrode having one or more electrode elements each having openings which directly or electrically expose at least part of the gates and the electrode groups with the gates to the developer support;

a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around the gates, to the developer carried on the developer support is controlled by shield electrode;

wherein the degree of exposure of the arbitrary one of the gates or the electrode groups disposed around the gates, to the developer carried on the developer support is controlled by governing at least one or combination of the positional relationship of the shield electrode relative to the developer support and the electrode group, the relative potential difference of the shield electrode relative to the developer support and the electrode group and the ratio of the exposed portion of the shield electrode to that of the electrode group, and the degree of exposure is made different for each gate or each electrode group; and wherein the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

9. An image forming apparatus comprising:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming passages for the developer;

one or more electrode groups provided covering a multiple number of the gates; and a shield electrode having one or more electrode elements each having openings which directly or electrically expose at least part of the gates and the electrode groups with the gates to the developer support;

a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around the gates, to the developer carried on the developer support is controlled by shield electrode;

wherein the degree of exposure which is controlled by governing at least one or combination of the positional relationship of the shield electrode relative to the developer support and the electrode groups, the relative potential difference of the shield electrode relative to the developer support and the electrode group and the ratio of the exposed portion of the shield electrode to that of the electrode group, is controlled so as to vary in accordance with the distance between the gate and the developer or the strength of the electric field generated by the control means, and individual control is performed for each gate or identical control is performed for a plurality of gates; and wherein the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

10. An image forming apparatus comprising:

a supplying means at least having a developer support carrying one color of developer;

an opposing electrode disposed facing the developer support;

a control electrode at least comprising:

an insulative substrate disposed between the developer support and the opposing electrode;

a plurality of gates formed in the insulative substrate for forming passages for the developer;

one or more electrode groups provided covering a multiple number of the gates;

a first shield electrode disposed between the electrode groups and the opposing electrode and having one or more electrode elements each having openings which directly or electrically expose at least part of gates and the electrode groups with the gates, to the developer support; and a second shield electrode disposed between the electrode groups and the opposing electrode and having one or more electrode elements each having openings which directly or electrically expose at least part of gates and the electrode groups with the gates, to the developer support; and a control means having a control circuit means which is able to apply a predetermined voltage to each electrode on the control electrode in accordance with the image data, wherein the control means controls the passage of the developer through the gates by applying the designated voltage to the corresponding electrodes of the electrode groups so as to form an image on the surface of a recording medium which is being conveyed between the control electrode and the opposing electrode, characterized in that the degree of exposure of an arbitrary one of gates or electrode groups disposed around gates, to the developer carried on the developer support is controlled by the first or the second shield electrode or combined function of the first and second shield electrodes; and wherein the degree of exposure of gates or the electrode provided for the gates is controlled by varying the diameter of the openings in the shield electrode in a continuous manner or stepwise with the size of the openings in the electrode groups fixed, in accordance with the distance from the electrode group arranged on the gates to the developer support or to the developer carried on the developer support, so as to control the ratio of an opening in the electrode group to the corresponding opening formed in the shield electrode.

11. The image forming apparatus according to claim 10, wherein the control by the shield electrode is further characterized in that degrees of electrical exposure of the electrode groups are set greater as they are positioned more downstream with respect to the direction of conveyance of the developer supported on the developer support.

* * * * *